US009222318B2

(12) United States Patent
DeBerry et al.

(10) Patent No.: US 9,222,318 B2
(45) Date of Patent: Dec. 29, 2015

(54) SYSTEMS AND METHODS FOR RISER COUPLING

(71) Applicant: Dril-Quip, Inc., Houston, TX (US)

(72) Inventors: Blake T. DeBerry, Houston, TX (US); Morris B. Wade, Tomball, TX (US); James Daryl Kizer, Houston, TX (US); Michael J. Lynch, Katy, TX (US); Sascha Antonio Castriotta, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 14/618,453

(22) Filed: Feb. 10, 2015

(65) Prior Publication Data

US 2015/0152698 A1 Jun. 4, 2015

Related U.S. Application Data

(63) Continuation-in-part of application No. 13/892,823, filed on May 13, 2013, now Pat. No. 8,978,770.

(60) Provisional application No. 61/646,847, filed on May 14, 2012.

(51) Int. Cl.

| | |
|---|---|
| ***E21B 17/02*** | (2006.01) |
| ***E21B 17/08*** | (2006.01) |
| ***E21B 19/06*** | (2006.01) |
| ***E21B 19/16*** | (2006.01) |
| ***E21B 17/01*** | (2006.01) |
| ***E21B 17/046*** | (2006.01) |
| ***E21B 19/00*** | (2006.01) |
| ***E21B 19/10*** | (2006.01) |
| ***E21B 19/24*** | (2006.01) |

(52) U.S. Cl.

CPC ..... *E21B 19/165* (2013.01); *E21B 17/01* (2013.01); *E21B 17/046* (2013.01); *E21B 17/085* (2013.01); *E21B 19/002* (2013.01); *E21B 19/06* (2013.01); *E21B 19/10* (2013.01); *E21B 19/16* (2013.01); *E21B 19/24* (2013.01)

(58) Field of Classification Search

CPC ..... E21B 17/085
USPC ..... 166/344, 360, 367, 379, 77.51, 85.1; 285/922; 405/169, 170

See application file for complete search history.

(56) References Cited

U.S. PATENT DOCUMENTS

| | | | | |
|---|---|---|---|---|
| 4,491,346 | A * | 1/1985 | Walker | 285/18 |
| 4,496,172 | A * | 1/1985 | Walker | 285/18 |
| 4,557,508 | A * | 12/1985 | Walker | 285/84 |
| 5,421,623 | A * | 6/1995 | Cassin | 285/343 |
| 5,441,311 | A * | 8/1995 | Watkins | 285/18 |
| 5,634,671 | A * | 6/1997 | Watkins | 285/18 |
| 7,331,395 | B2 * | 2/2008 | Fraser et al. | 166/345 |

(Continued)

*Primary Examiner* — Matthew Buck
(74) *Attorney, Agent, or Firm* — Baker Botts L.L.P.

(57) ABSTRACT

Systems and methods for riser coupling are disclosed. A riser coupling system comprises a riser joint connector comprising a first tubular assembly coupled to a second tubular assembly. The riser coupling system further comprises a spider assembly which receives the riser joint connector and has a connector actuation tool. The connector actuation tool comprises a dog assembly, a clamping tool and a splined member. The dog assembly selectively extends a dog to engage the riser joint connector. The clamping tool couples the first tubular assembly and the second tubular assembly. Finally, the splined member actuates a locking member of the riser joint connector.

20 Claims, 21 Drawing Sheets

(56) References Cited

U.S. PATENT DOCUMENTS

| | | | | |
|---|---|---|---|---|
| 7,337,848 | B2 * | 3/2008 | Fraser et al. | 166/345 |
| 7,503,391 | B2 * | 3/2009 | McCanna et al. | 166/343 |
| 7,686,087 | B2 * | 3/2010 | Pallini et al. | 166/367 |
| 7,686,342 | B2 * | 3/2010 | Jennings et al. | 285/39 |
| 7,913,767 | B2 * | 3/2011 | Larson et al. | 166/380 |
| 7,963,336 | B2 * | 6/2011 | Fraser et al. | 166/345 |
| 7,975,768 | B2 * | 7/2011 | Fraser et al. | 166/345 |
| 8,312,933 | B2 * | 11/2012 | Larson et al. | 166/380 |
| 8,317,234 | B2 * | 11/2012 | McKay | 285/81 |
| 8,356,672 | B2 * | 1/2013 | Fraser et al. | 166/345 |
| 8,978,770 | B2 * | 3/2015 | DeBerry et al. | 166/344 |
| 2011/0204143 | A1 * | 8/2011 | Mackenzie et al. | 235/385 |
| 2012/0172072 | A1 * | 7/2012 | Baxter et al. | 455/500 |
| 2014/0060851 | A1 * | 3/2014 | Mackenzie et al. | 166/367 |

* cited by examiner

SYSTEMS AND METHODS FOR RISER COUPLING

CROSS-REFERENCE TO RELATED APPLICATION

The present application is a continuation in part of U.S. patent application Ser. No. 13/892,823, entitled "Systems and Methods for Riser Coupling", filed on May 13, 2013, which claimed the benefit of provisional application Ser. No. 61/646,847, entitled "Systems and Methods for Riser Coupling", filed on May 14, 2012.

BACKGROUND

The present disclosure relates generally to well risers and, more particularly, to systems and methods for riser coupling.

In drilling or production of an offshore well, a riser may extend between a vessel or platform and the wellhead. The riser may be as long as several thousand feet, and may be made up of successive riser sections. Riser sections with adjacent ends may be connected on board the vessel or platform, as the riser is lowered into position. Auxiliary lines, such as choke, kill, and/or boost lines, may extend along the side of the riser to connect with the wellhead, so that fluids may be circulated downwardly into the wellhead for various purposes. Connecting riser sections in end-to-end relation includes aligning axially and angularly two riser sections, including auxiliary lines, lowering a tubular member of an upper riser section onto a tubular member of a lower riser section, and locking the two tubular members to one another to hold them in end-to-end relation.

The riser section connecting process may require significant operator involvement that may expose the operator to risks of injury and fatigue. For example, the repetitive nature of the process over time may create a risk of repetitive motion injuries and increasing potential for human error. Moreover, the riser section connecting process may involve heavy components and may be time-intensive. Therefore, there is a need in the art to improve the riser section connecting process and address these issues.

BRIEF DESCRIPTION OF THE DRAWINGS

Some specific exemplary embodiments of the disclosure may be understood by referring, in part, to the following description and the accompanying drawings.

Figure 1A:
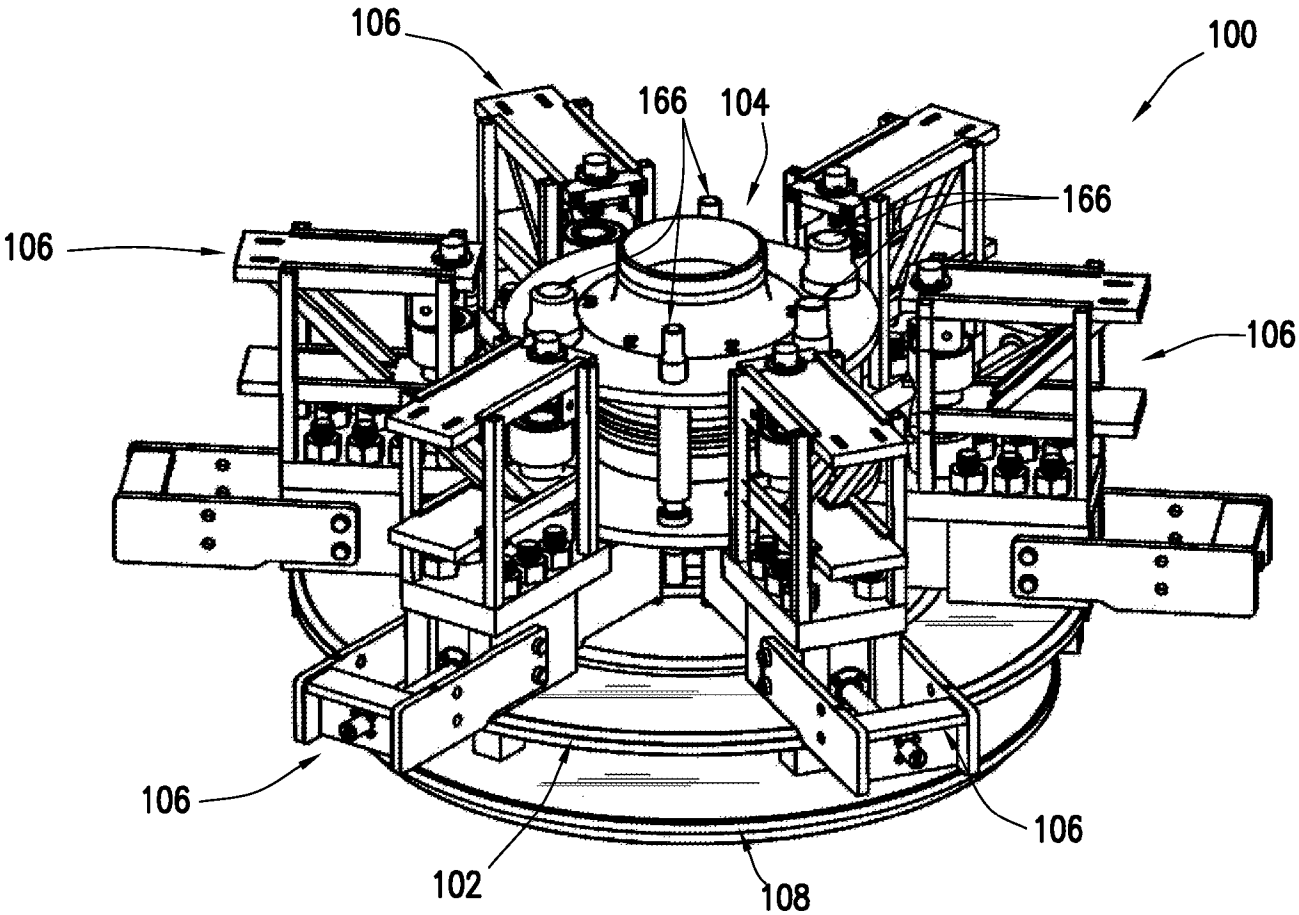
FIG. 1A shows an angular view of one exemplary riser coupling system, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well risers and, more particularly, to systems and methods for riser coupling.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves; and/or any combination of the foregoing.

For the purposes of this disclosure, a sensor may include any suitable type of sensor, including but not limited to optical, radio frequency, acoustical, pressure, torque, or proximity sensors.

Figure 1B:
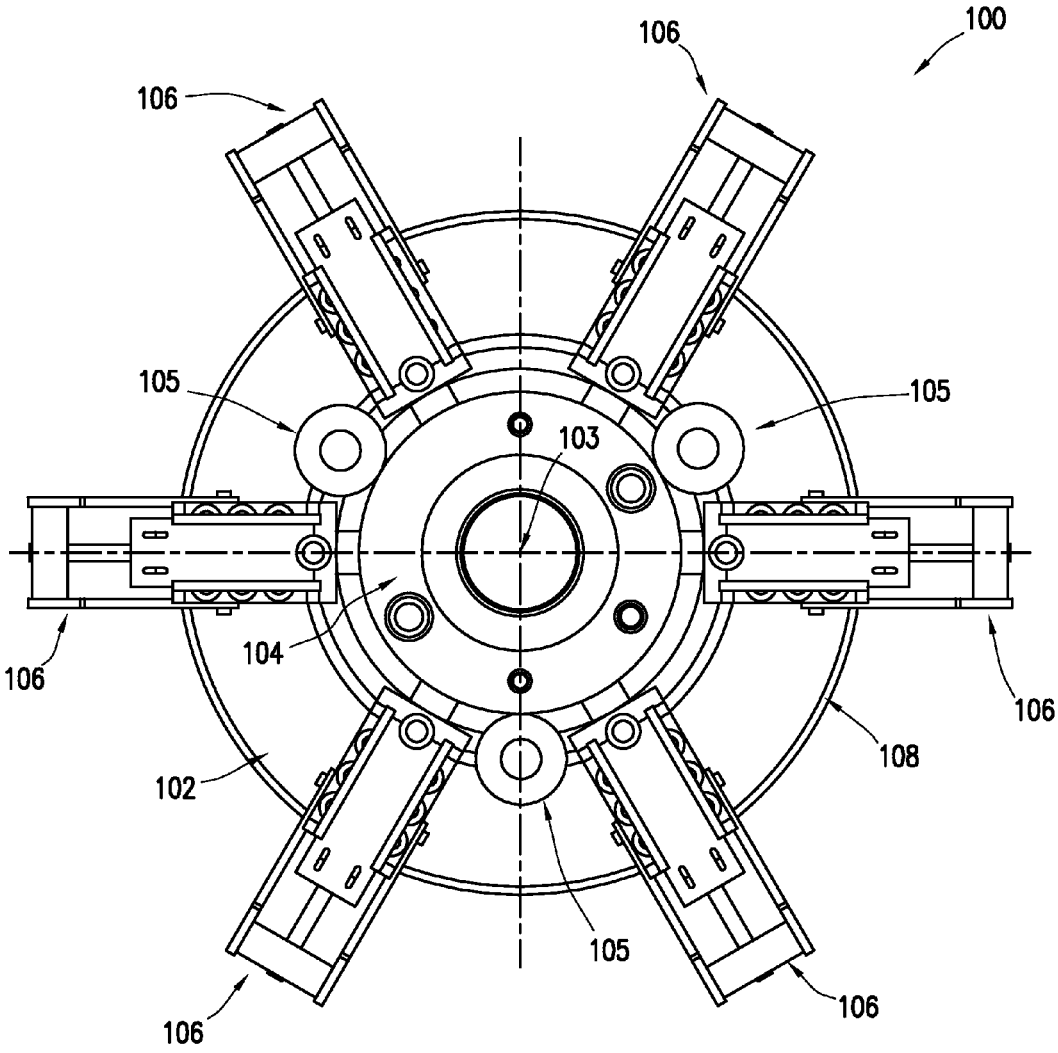
FIG. 1B shows a top view of a riser coupling system, in accordance with certain embodiments of the present disclosure.

FIG. 1A shows an angular view of one exemplary riser coupling system 100, in accordance with certain embodiments of the present disclosure. FIG. 1B shows a top view of the riser coupling system 100. The riser coupling system 100 may include a spider assembly 102 adapted to one or more of receive, at least partially orient, engage, hold, and actuate a riser joint connector 104. The spider assembly 102 may include one or more connector actuation tools 106. In certain embodiments, a plurality of connector actuation tools 106 may be spaced radially about an axis 103 of the spider assembly 102. By way of nonlimiting example, two connector actuation tools 106 may be disposed around a circumference of the spider assembly 102 in an opposing placement. The nonlimiting example of FIG. 1 show three pairs of opposing connector actuation tools 106. It should be understood that various embodiments may include any suitable number of connector actuation tools 106.

As depicted in FIG. 1B, certain embodiments may include one or more orienting members 105 disposed radially about the axis 103 to facilitate orientation of the riser joint connector 104. By way of example without limitation, three orienting members 105 may include a cylindrical or generally cylindrical form extending upwards from a surface of the spider assembly 102. The orienting members 105 may act as guides to interface the riser joint connector 104 as the riser joint connector 104 is lowered toward the spider assembly 102, thereby facilitating orientation and/or alignment. In certain embodiments, the orienting members 105 may be fitted with one or more sensors (not shown) to detect position and/or orientation of the riser joint connector 104, and corresponding signals may be transferred to an information handling system at any suitable location on a vessel or platform by any suitable means, including wired or wireless means.

The spider assembly 102 may include a base 108. The base 108, and the spider assembly 102 generally, may be mounted directly or indirectly on a surface of a vessel or platform. For example, the base 108 may be disposed on or proximate to a rig floor. In certain embodiments, the base 108 may include or be coupled to a gimbal mount to facilitate balancing in spite of sea sway.

Figure 12:
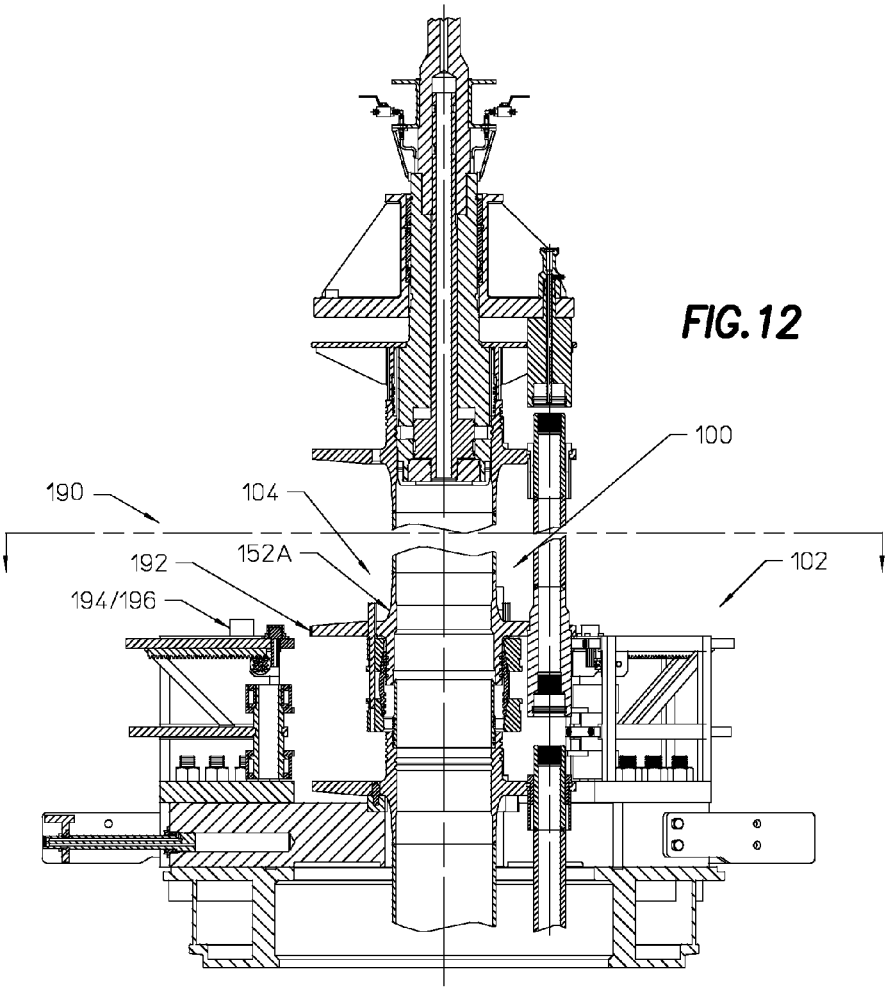
FIG. 12 shows a schematic view of an orientation system for aligning a riser joint within a riser coupling system, in accordance with certain embodiments of the present disclosure.

As mentioned above, certain embodiments of the spider assembly 102 and the riser connector assembly 104 may be fitted with sensors to enable determination of an orientation of the riser connector assembly 104 being positioned within the spider 102 (e.g., via a running tool). As illustrated in FIG. 12, for example, the riser coupling system 100 may include a radio frequency identification (RFID) based orientation system 190 for aligning a riser joint connector 104 within the riser coupling system 100. This RFID orientation system 190 may include one or more RFID tags 192 disposed on the riser joint connector 104 and an RFID reader 194 disposed on a section of the spider assembly 102, with one or more RFID antennae.

Each RFID tag 192 may be an electronic device that absorbs electrical energy from a radio frequency (RF) field. The RFID tag 192 may then use this absorbed energy to broadcast an RF signal containing a unique serial number to the RFID reader 194. In some embodiments, the RFID tags 192 may include on-board power sources (e.g., batteries) for powering the RFID tags 192 to output their unique RF signals to the reader 194. The signal output from the RFID tags 192 may be within the 900 MHz frequency band.

The RFID reader 194 may be a device specifically designed to emit RF signals and having an antenna to capture information (i.e., RF signals with serial numbers) from the RFID tags 192. The RFID reader 194 may respond differently depending on the relative position of the reader 194 to the one or more tags 192. For example, the RFID reader 194 may slowly capture the RF signal from the RFID tag 192 when the RFID tag 192 and the antenna of the RFID reader 194 are far apart. This may be the case when the riser joint connector 104 is out of alignment with the spider assembly 102. The RFID reader 194 may quickly capture the signal from the RFID tag 192 when the optimum alignment between the antenna of the reader 194 and the RFID tag 192 is achieved. In the illustrated embodiment, the riser joint connector 104 is oriented about the axis 103 such that one of the RFID tags 192 is as close as possible to the RFID reader 194, indicating that the riser joint connector 104 is in a desired rotational alignment within the riser coupling system 100.

The change in speed of response of the RFID reader 194 may be related to the field strength of the signal from the RFID tag 192 and may be directly related to the distance between the RFID tag 192 (transmitter) and the RFID reader 194 (receiver). The RFID reader 194 may take a signal strength measurement, also known as "receiver signal strength indicator" (RSSI), and provide this measurement to a controller 196 (e.g., information handling system) to determine whether the riser joint connector 104 is aligned with the spider assembly 102. The RSSI may be an electrical signal or computed value of the strength of the RF signal received via the RFID reader 194. An internally generated signal of the RFID reader 194 may be used to tune the receiver for optimal signal reception. The controller 196 may be communicatively coupled to the RFID reader 194 via a wired or wireless connection, and the controller 196 may also be communicatively coupled to actuators, running tools, or various operable components of the spider assembly 102.

In some embodiments, the RFID reader 194 may emit a constant power level RF signal, in order to activate any RFID tags 192 that are within range of the RF signal (or RF field). It may be desirable for the RFID reader 192 to emit a constant power signal, since the RF signal strength output from the RFID tags 192 is proportional to both distance and frequency of the signal. In the application described herein, the distance from the antenna of the RFID reader 194 to the RFID tag 192 may be used to locate the angular position of the riser joint connector 104 relative to the RFID reader 194.

Figure 13:
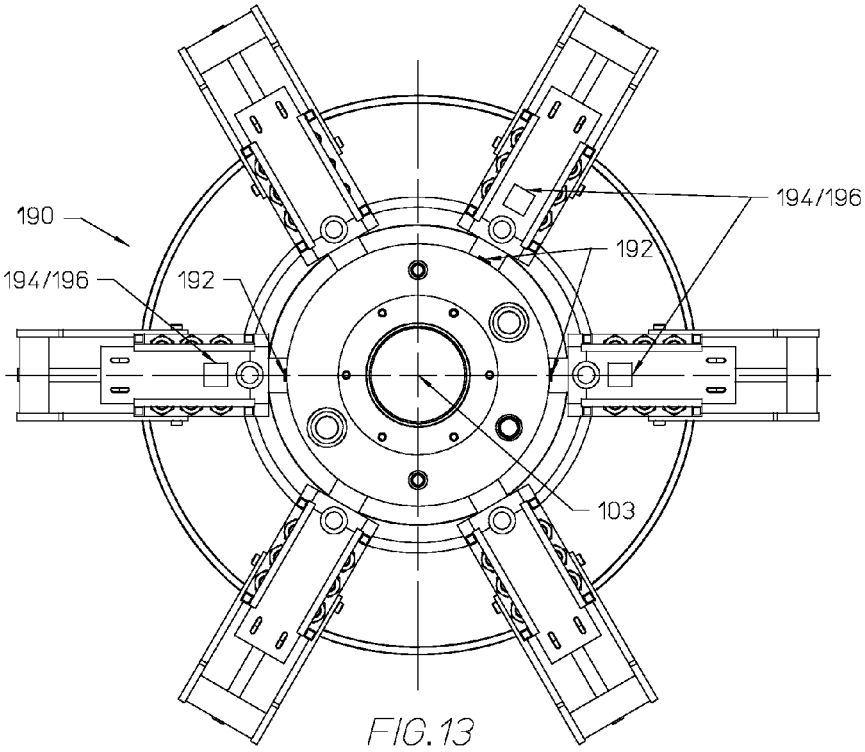
FIG. 13 shows a schematic view of a section of a riser joint with multiple RFID tags positioned thereon, in accordance with certain embodiments of the present disclosure.

In certain embodiments, the one or more RFID tags 192 may be disposed on a flange of a riser tubular that forms part of the riser joint connector 104. For example, the RFID tags 192 may be embedded onto a lower riser flange 152A of a tubular assembly 152 being connected with other tubular assemblies via the riser coupling system 100. From this position, the RFID tags 192 may react to the RF field from the RFID reader 194. It may be desirable to embed the RFID tags 192 into only one of two available riser flanges 152A along the tubular assembly 152, since RFID tags disposed on two adjacent riser flanges being connected could cause undesirable interference in the signal readings taken by the reader 194. As illustrated in FIG. 13, the flange 152A of the riser joint connector 104 may include three RFID tags 192 disposed thereabout. It should be noted that other numbers (e.g., 1, 2, 4, 5, or 6) of the RFID tags 192 may be disposed about the flange 152A in other embodiments. In some embodiments, the multiple RFID tags 192 may be generally disposed at equal rotational intervals around the flange 152A. In other embodiments, such as the illustrated embodiment of FIG. 13, the RFID tags 192 may be positioned in other arrangements. In still other embodiments, the RFID tags 192 may be disposed along other parts of the riser joint connector 104.

In some embodiments, a single RFID reader 194 may be used to detect RF signals indicative of proximity of the RFID tags 192 to the reader 194. The use of one RFID reader 194 may help to maintain a constant power signal emitted in the vicinity of the RFID tags 192 for initiating RF readings. In other embodiments, however, the RFID based orientation system 190 may utilize more than one reader 194. In the illustrated embodiment, the RFID reader 194 may be disposed on the spider assembly 102, near where the spider assembly 102 meets the riser joint connector 104. It should be noted that, in other embodiments, the RFID reader 194 may be positioned or embedded along other portions of the riser coupling system 100 that are rotationally stationary with respect to the spider assembly 102.

As the riser joint connector 104 is lowered to the spider assembly 102 for makeup, the RFID tags 192 embedded into the edge of the riser flange may begin to respond to the RF field output via the reader 194. Based on the Received Signal Strength Indication (RSSI) received at the RFID reader 194 in response to the RFID tags 192, the controller 196 may output a signal to a running tool and/or an orienting device to rotate the riser joint connector 104 about the axis 103. The tools may rotate the riser joint connector 104 until the riser joint connector 104 is brought into a desirable alignment with the spider assembly 102 based on the signal received at the reader 194. Upon aligning the riser joint connector 104, the running tool may then lower the riser joint connector 104 into the spider assembly 102, and the spider assembly 102 may actuate the riser joint connector 104 to lock the tubular assembly 152 to a lower tubular assembly (not shown).

Once the riser joint connector 104 is locked and lowered into the sea, the RFID tags 192 may shut off in response to the tags 192 being out of range of the RFID transmitter/reader 194. In embodiments where the electrical power is transferred to the RFID tags 192 via RF signals from the reader 194, there are no batteries to change out or any concerns over electrical connections to the RFID tags 192 that are then submersed in water. The RFID orientation system 190 may provide accurate detection of the rotational positions of the riser joint connector 104 with respect to the spider assembly 102 before setting the riser joint connector 104 in place and making the riser connection. By sensing the signal strength of embedded RFID tags 192, the RFID orientation system 190 is able to provide this detection without the use of complicated mechanical means (e.g., gears, pulleys) or electronic encoders for detecting angular rotation and alignment. Once the alignment of the riser joint connector 104 is achieved, the RFID reader 190 may shutoff the RF power transmitter 194, thereby silencing the RFID tags 192.

Figure 2:
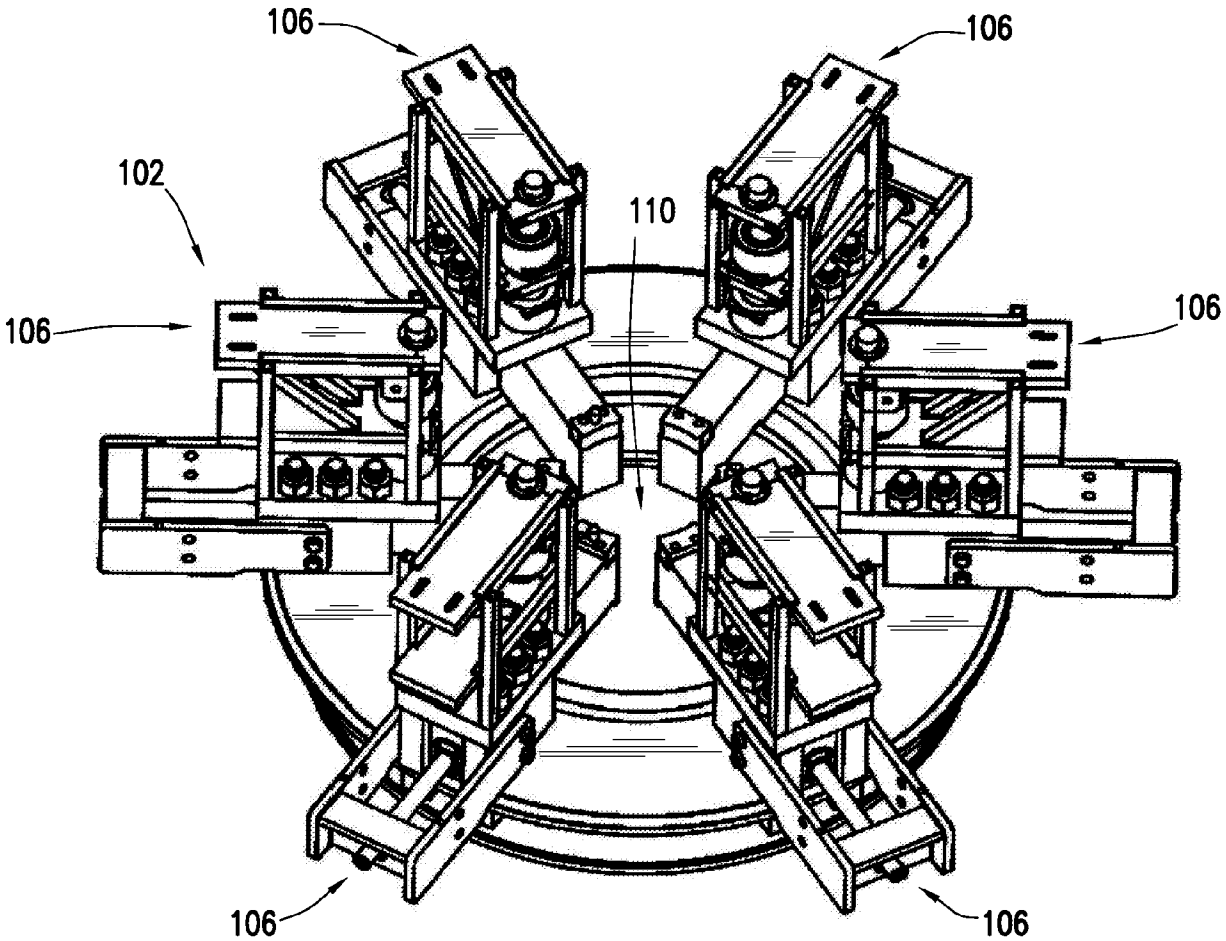
FIG. 2 shows a top elevational view of a spider assembly prior to receiving a connector assembly, in accordance with certain embodiments of the present disclosure.

FIG. 2 shows an angular view of the spider assembly 102 prior to receiving the riser joint connector 104 (depicted in FIGS. 1A and 1B). The nonlimiting example of the spider assembly 102 with the base 108 includes a generally circular geometry about a central opening 110 configured for running riser sections therethrough. Various alternative embodiments may include any suitable geometry.

Figure 3A:
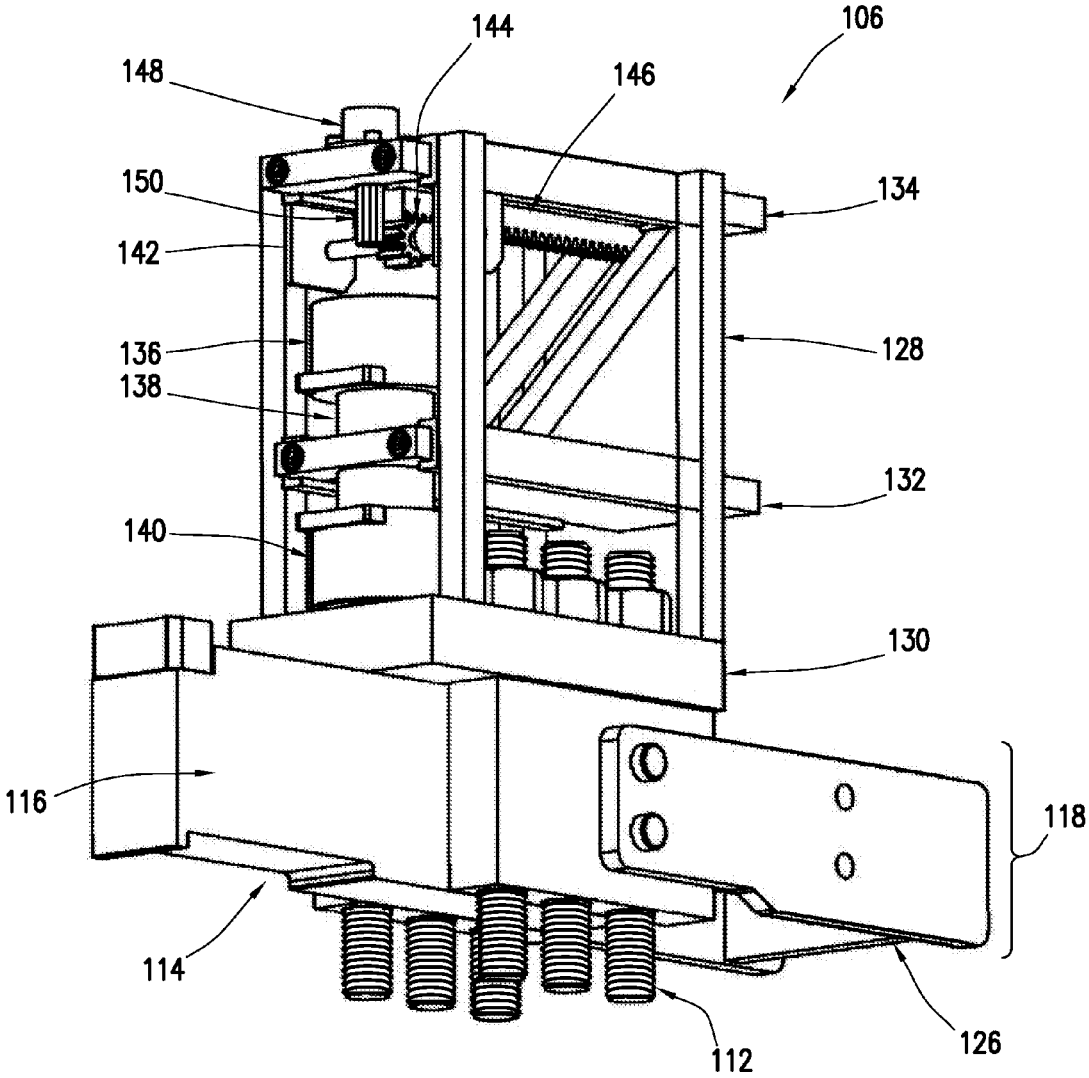
FIG. 3A shows a side elevational view of one exemplary connector actuation tool, in accordance with certain embodiments of the present disclosure.
Figure 3B:
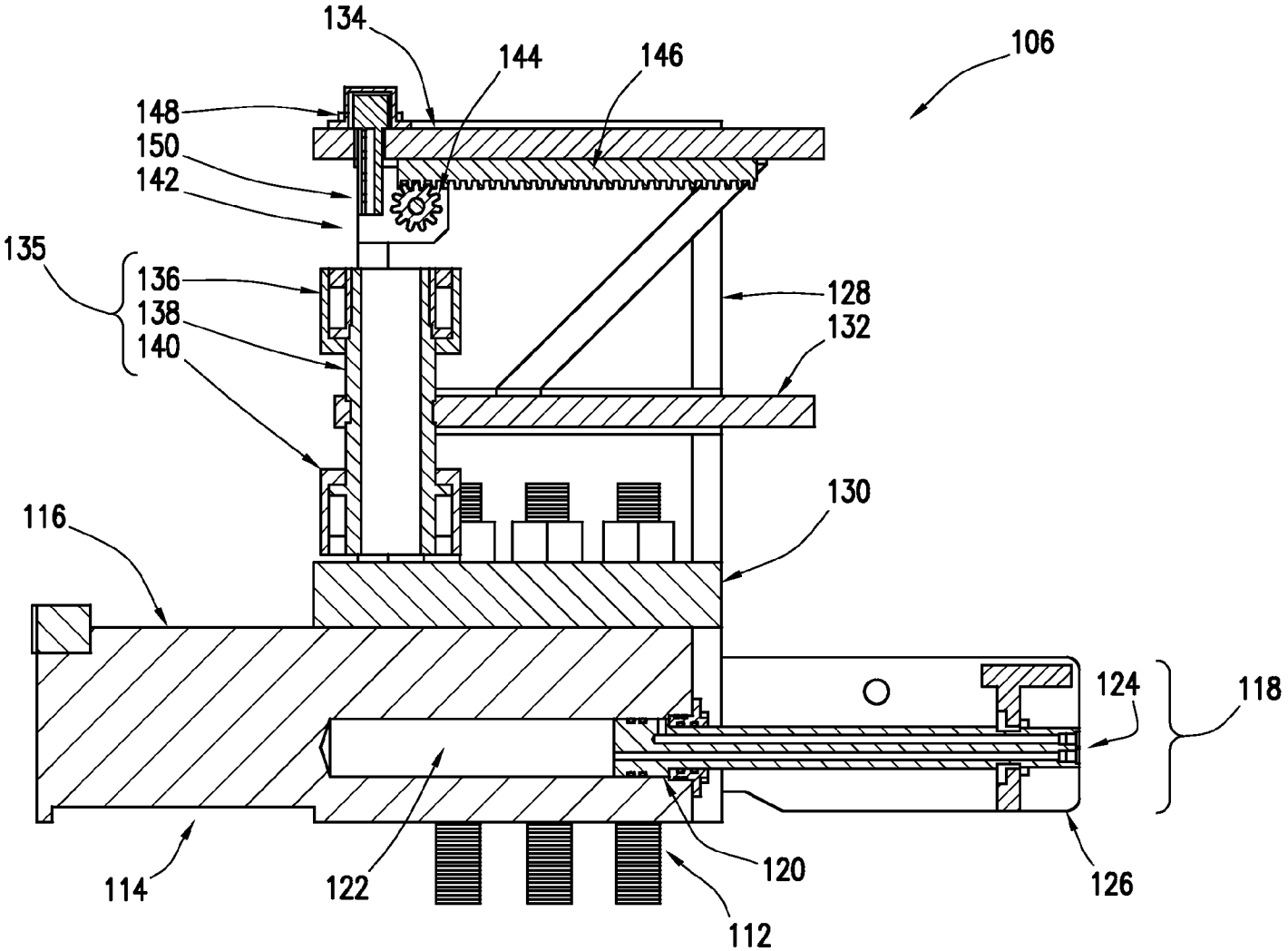
FIG. 3B shows a cross-sectional view of a connector actuation tool, in accordance with certain embodiments of the present disclosure.

FIG. 3A shows an angular view of one exemplary connector actuation tool 106, in accordance with certain embodiments of the present disclosure. FIG. 3B shows a cross-sectional view of the connector actuation tool 106. The connector actuation tool 106 may include a connection means 112 to allow connection to the base 108 (omitted in FIGS. 3A, 3B). As depicted, the connection means 112 may include a number of threaded bolts. However, it should be appreciated that any suitable means of coupling, directly or indirectly, the connector actuation tool 106 to the rest of the spider assembly 102 (omitted in FIGS. 3A, 3B) may be employed.

The connector actuation tool 106 may include a dog assembly 114. The dog assembly 114 may include a dog 116 and a piston assembly 118 configured to move the dog 116. The piston assembly 118 may include a piston 120, a piston cavity 122, one or more hydraulic lines 124 to be fluidly coupled to a hydraulic power supply (not shown), and a bracket 126. The bracket 126 may be coupled to a support frame 128 and the piston 120 so that the piston 120 remains stationary relative to the support frame 128. The support frame 128 may include or be coupled to one or more support plates. By way of example without limitation, the support frame 128 may include or be coupled to support plates 130, 132, and 134. The support plate 130 may provide support to the dog 116.

With suitable hydraulic pressure applied to the piston assembly 118 from the hydraulic power supply (not shown), the piston cavity 122 may be pressurized to move the dog 116 with respect to one or more of the piston 120, the bracket 126, the support frame 128, and the support plate 130. In the non-limiting example depicted, each of the piston 120, the bracket 126, the support frame 128, and the support plate 130 is adapted to remain stationary though the dog 116 moves. FIGS. 3A and 3B depict the dog 116 in an extended state relative to the rest of the connector actuation tool 106.

The connector actuation tool 106 may include a clamping tool 135. By way of example without limitation, the clamping tool 135 may include one or more of an upper actuation piston 136, an actuation piston mandrel 138, and a lower actuation piston 140. Each of the upper actuation piston 136 and the lower actuation piston 140 may be fluidically coupled to a hydraulic power supply (not shown) and may be moveably coupled to the actuation piston mandrel 138. With suitable hydraulic pressure applied to the upper and lower actuation pistons 136, 140, the upper and lower actuation pistons 136, 140 may move longitudinally along the actuation piston mandrel 138 toward a middle portion of the actuation piston mandrel 138. FIGS. 3A and 3B depict the upper and lower actuation pistons 136, 140 in a non-actuated state.

The actuation piston mandrel 138 may be extendable and retractable with respect to the support frame 128. A motor 142 may be drivingly coupled to the actuation piston mandrel 138 to selectively extend and retract the actuation piston mandrel 138. By way of example without limitation, the motor 142 may be drivingly coupled to a slide gear 144 and a slide gear rack 146, which may in turn be coupled to the support plate 134, the support plate 132, and the actuation piston mandrel 138. The support plates 132, 134 may be moveably coupled to the support frame 128 to extend or retract together with the actuation piston mandrel 138, while the support frame 128 remains stationary. FIGS. 3A and 3B depict the slide gear rack 146, the support plates 132, 134, and the actuation piston mandrel 138 in a retracted state relative to the rest of the connector actuation tool 106.

The connector actuation tool 106 may include a motor 148, which may be a torque motor, mounted with the support plate 134 and driving coupled to a splined member 150. The splined member 150 may also be mounted to extend and retract with the support plate 134. It should be understood that while one non-limiting example of the connector actuation tool 106 is depicted, alternative embodiments may include suitable variations, including but not limited to, a dog assembly at an upper portion of the connector actuation tool, any suitable number of actuation pistons at any suitable position of the connector actuation tool, any suitable motor arrangements, and the use of electric actuators instead of or in combination with hydraulic actuators.

In certain embodiments, the connector actuation tool 106 may be fitted with one or more sensors (not shown) to detect position, orientation, pressure, and/or other parameters of the connector actuation tool 106. For nonlimiting example, one or more sensors may detect the positions of the dog 116, the clamping tool 135, and/or splined member 150. Corresponding signals may be transferred to an information handling system at any suitable location on the vessel or platform by any suitable means, including wired or wireless means. In certain embodiments, control lines (not shown) for one or more of the motor 148, clamping tool 135, and dog assembly 114 may be feed back to the information handling system by any suitable means.

Figure 4:
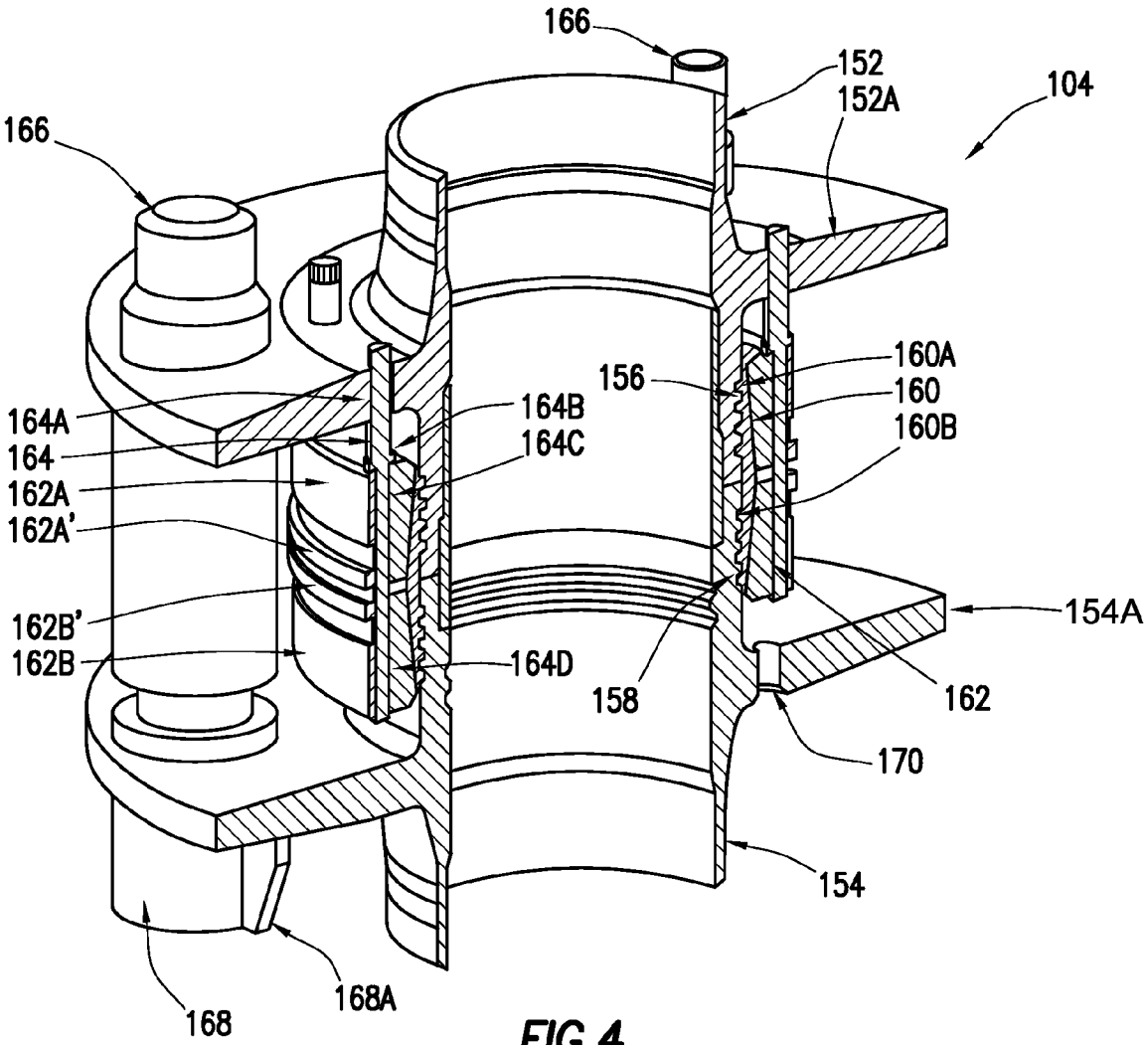
FIG. 4 shows a partially cut-away side elevational view of a connector assembly, in accordance with certain embodiments of the present disclosure.

FIG. 4 shows a cross-sectional view of a riser joint connector 104, in accordance with certain embodiments of the present disclosure. The riser joint connector 104 may include an upper tubular assembly 152 and a lower tubular assembly 154, each arranged in end-to-end relation. The upper tubular assembly 152 sometimes may be referenced as a box; the lower tubular assembly 154 may be referenced as a pin.

Certain embodiments may include a seal ring (not shown) between the tubular members 152, 154. The upper tubular assembly 152 may include grooves 156 about its lower end. The lower member 154 may include grooves 158 about its upper end. A lock ring 160 may be disposed about the grooves 156, 158 and may include teeth 160A, 160B. The teeth 160A, 160B may correspond to the grooves 156, 158. The lock ring 160 may be radially expandable and contractible between an unlocked position in which the teeth 160A, 160B are spaced from the grooves 156, 158, and a locking position in which the lock ring 160 has been forced inwardly so that teeth 160A, 160B engage with the grooves 156, 158 and thereby lock the connection. Thus, the lock ring 160 may be radially moveable between a normally expanded, unlocking position and a radially contracted locking position, which may have an interference fit. In certain embodiments, the lock ring 160 may be split about its circumference so as to normally expand outwardly to its unlocking position. In certain embodiments, the lock ring 160 may include segments joined to one another to cause it to normally assume a radially outward position, but be collapsible to contractible position.

A cam ring 162 may be disposed about the lock ring 160 and may include inner cam surfaces that can slide over surfaces of the lock ring 160. The cam surfaces of the cam ring 162 may provide a means of forcing the lock ring 160 inward to a locked position. The cam ring 162 may include an upper member 162A and a lower member 162B with corresponding lugs 162A' and 162B'. The upper member 162A and the lower member 162B may be configured as opposing members. The cam ring 162 may be configured so that movement of the upper member 162A and the lower member 162B toward each other forces the lock ring 160 inward to a locked position via the inner cam surfaces of the cam ring 162.

The riser joint connector 104 may include one or more locking members 164. A given locking member 164 may be adapted to extend through a portion of the cam ring 162 to maintain the upper member 162A and the lower member 162B in a locking position where each has been moved toward the other to force the lock ring 160 inward to a locked position. The locking member 164 may include a splined portion 164A and may extend through a flange 152A of the upper tubular assembly 152. The locking member 164 may include a retaining portion 164B, which may include but not be limited to a lip, to abut the upper member 162A. The locking member 164 may include a tapered portion 164C to fit a portion of the upper member 162A. The locking member 164 may include a threaded portion 164D to engage the lower member 162B via threads.

Some embodiments of the riser joint connector 104 may include a secondary locking mechanism, in addition to the cam ring 162 and the lock ring 160. One such embodiment is illustrated in operation in FIGS. 14A-14D. As illustrated, the riser joint connector 104 may include the upper tubular assembly 152 having the flange 152A, the lower tubular assembly 154 having the flange 154A, the lock ring 160, the cam ring 162, and a secondary locking mechanism 210 disposed on the cam ring 162. The secondary locking mechanism 210 may include an outer solid (i.e., continuous) ring 212 with an engagement profile 214 and a split inner ring 216 having a complementary (i.e., matching) engagement profile 218. In the illustrated embodiment, these engagement profiles 214 and 218 may include rows of interlocking teeth. The outer ring 212 may be disposed on and coupled to the upper member 162A of the cam ring 162 while the split inner ring 216 is disposed on and coupled to the lower member 162B of the cam ring 162. In other embodiments, the outer ring 212 may be disposed on and coupled to the lower member 162B of the cam ring 162 while the split inner ring 216 is disposed on and coupled to the upper member 162A of the cam ring 162.

Figure 14A:
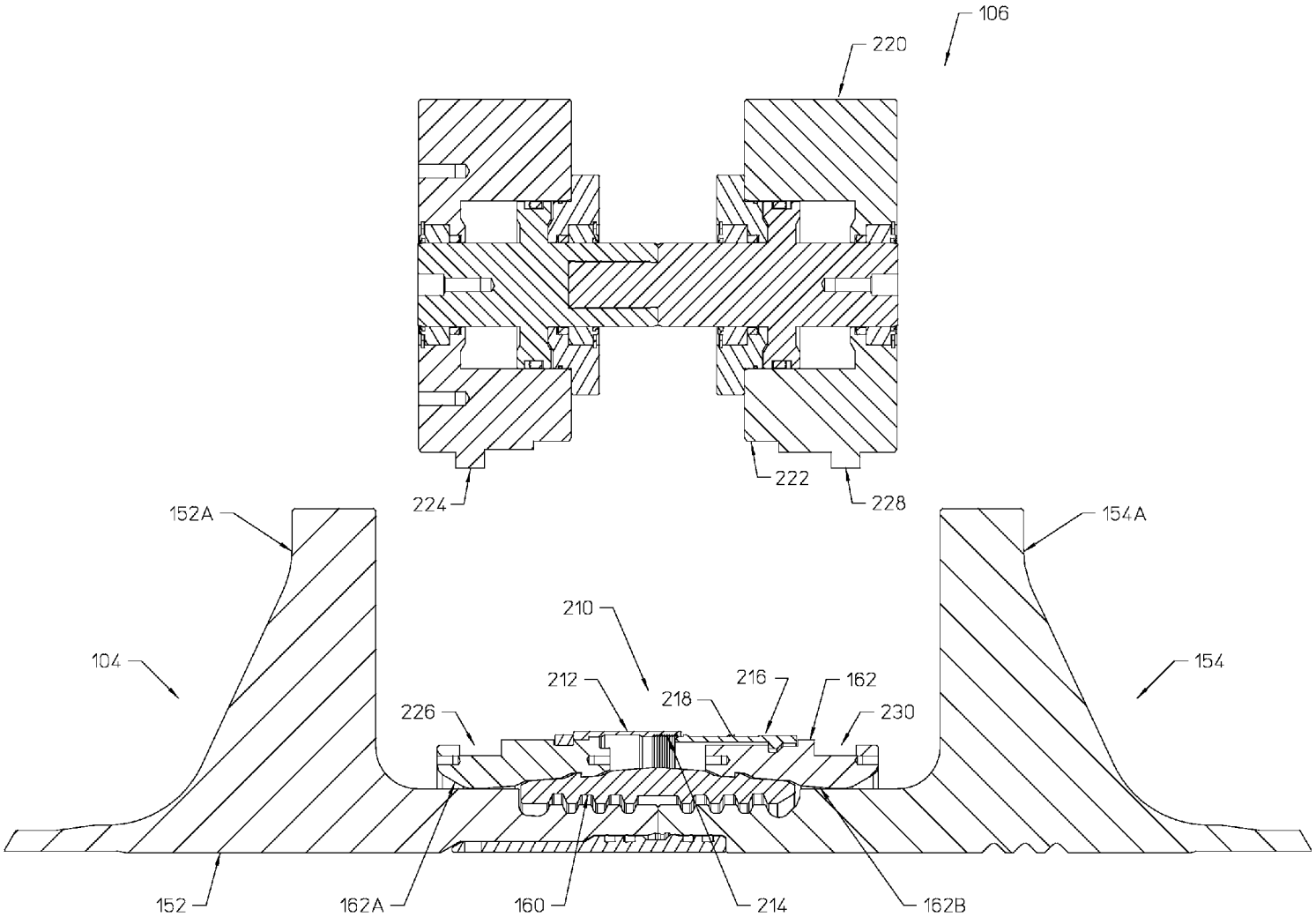
FIGS. 14A-14D show a cross-sectional view of a connector actuation tool being used to lock a connector assembly with a secondary lock, in accordance with certain embodiments of the present disclosure.

As illustrated in FIG. 14A, the split inner ring 216 may be coupled to the cam ring 162 such that the split inner ring 216 is collapsible toward the cam ring 162. For example, the split inner ring 162 may be coupled to the cam ring 162 via a spring or other biasing member that may be compressed in order to selectively collapse the split inner ring 216. In some embodiments, the connector actuation tool 106 may include a manipulator section 220 (similar to clamping tool 135 described above) with a built in shoulder 222 for collapsing the split inner ring 216. When the manipulator sections 220 of the connector actuation tool 106 are actuated toward the riser joint connector 104, the shoulder 222 on each of the manipulator sections 220 may contact the split inner ring 216 and apply a radial force inward. This radial force from the shoulder 222 of the manipulator section 220 may collapse the split inner ring 216 against the cam ring 162. This collapse of the split inner ring 216 is illustrated in detail in FIG. 14B.

Figure 14B:
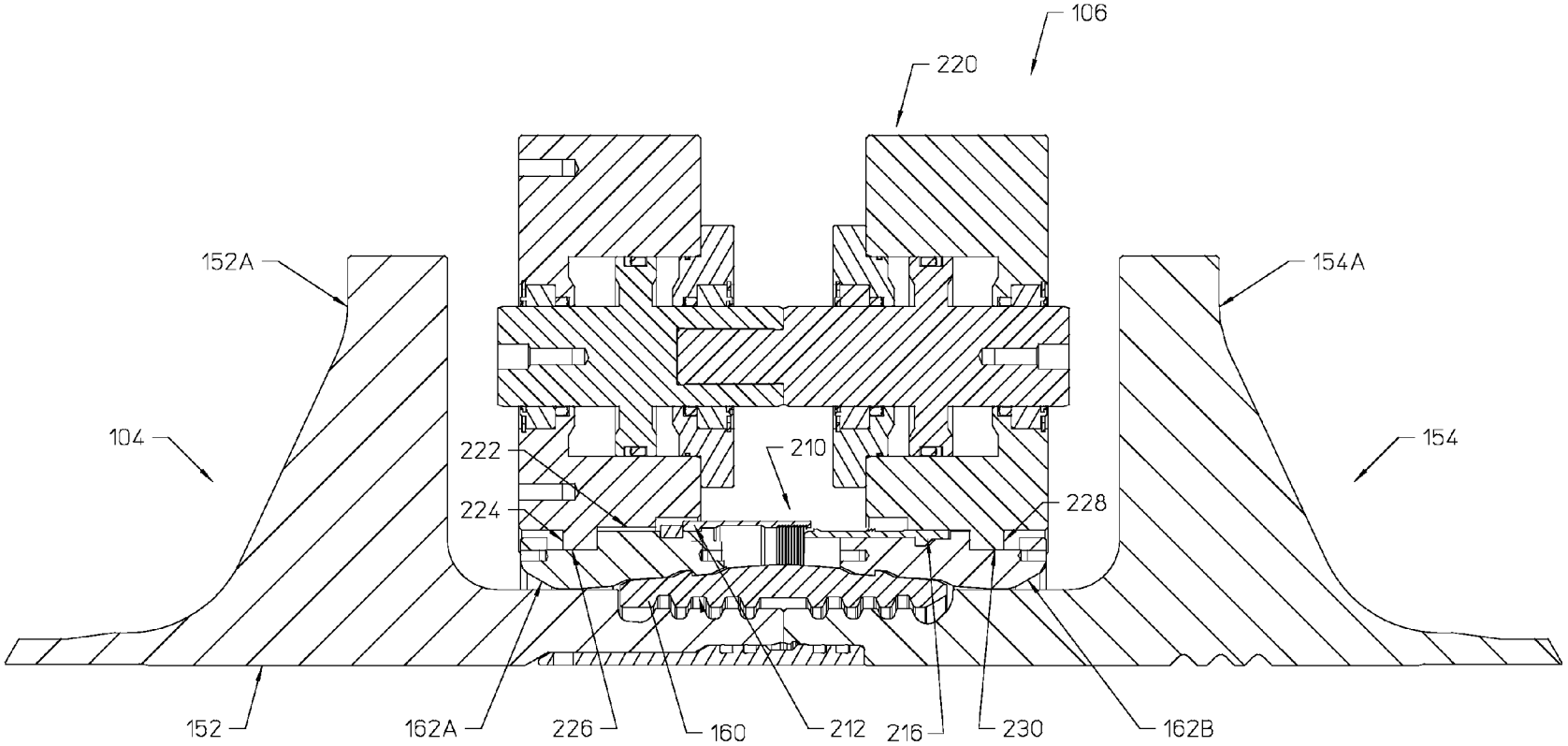
Figure 14C:
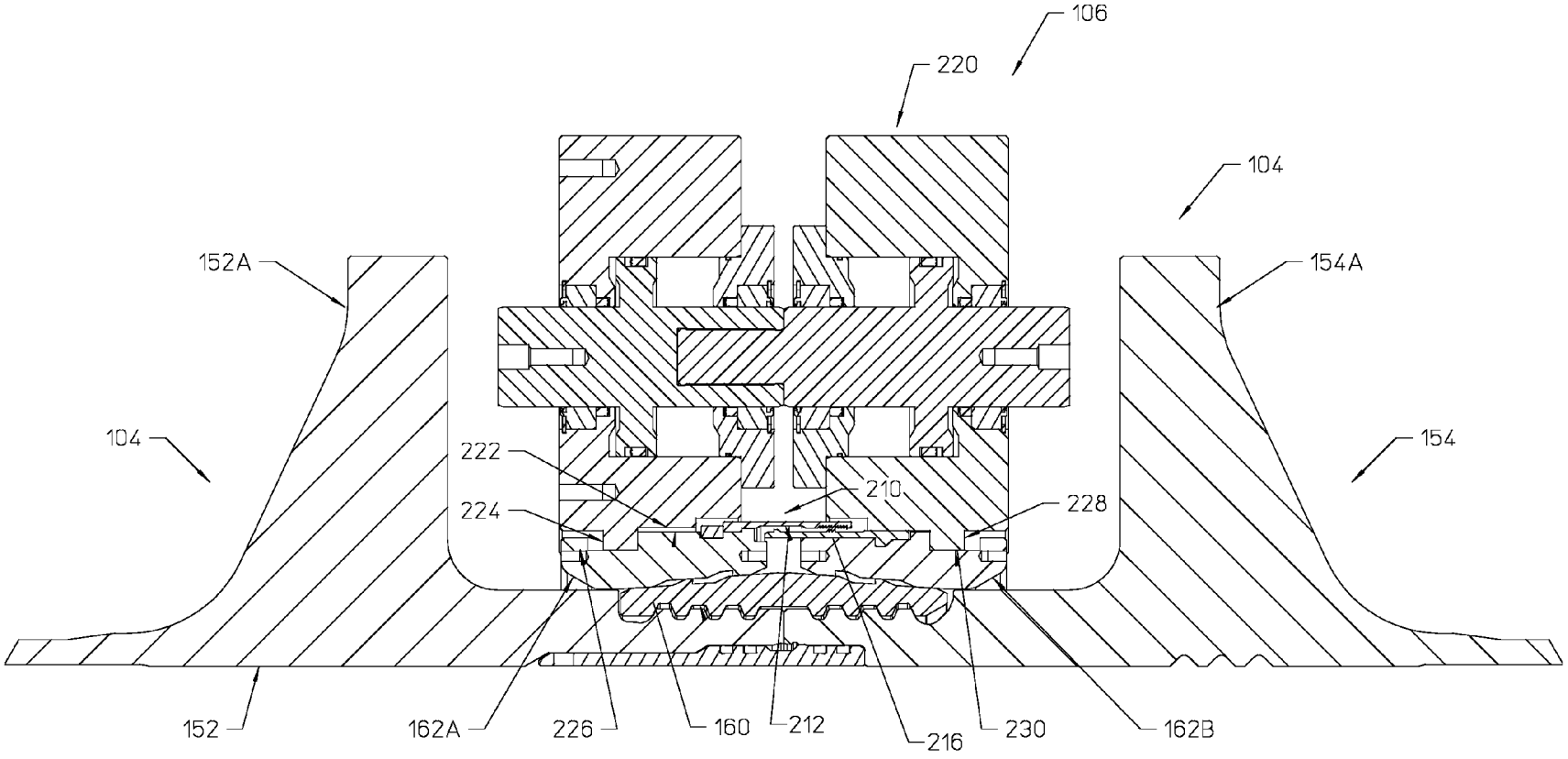

Upon its collapse, the split inner ring 216 may have a smaller outer diameter than the outer ring 212, as shown in FIG. 14B. At this point, the manipulator section 220 may be engaged with the cam ring 162. For example, the illustrated manipulator section 220 may include a projection 224 to engage a depression 226 formed in the upper member 162A of the cam ring 162, as well as a projection 228 to engage a depression 230 formed in the lower member 162B of the cam ring 162. In other embodiments, different types of engagement features may be used at this interface (e.g., piston sections of the manipulator 220 to be engaged with lugs on the cam ring 162). Once engaged with the cam ring 162, the manipulator section 220 may be actuated to force the cam ring members axially toward one another. As shown in FIG. 14C, this movement of the cam ring members 162A and 162B toward each other may be performed without the split inner ring 216 contacting the outer ring 212 of the secondary locking mechanism (e.g., due to the difference in outer diameter of the collapsed inner ring 216 and inner diameter of the outer ring 212).

Once the manipulator section 220 actuates the cam ring members 162 together, this locks the two riser flanges 152A and 154A together via the riser joint connector 104. As described above, for example, the cam ring members 162A and 162B may force the lock ring 160 into engagement with both the upper tubular assembly 152 and the lower tubular assembly 154. As shown in FIG. 14C, the cam ring members 162 may be positioned relative to one another such that the outer ring 212 and the split inner ring 216 of the secondary locking mechanism 210 are overlapping each other (without touching). Thus, in this position the split inner ring 216 may be disposed at least partially inside the outer ring 212.

Figure 14D:
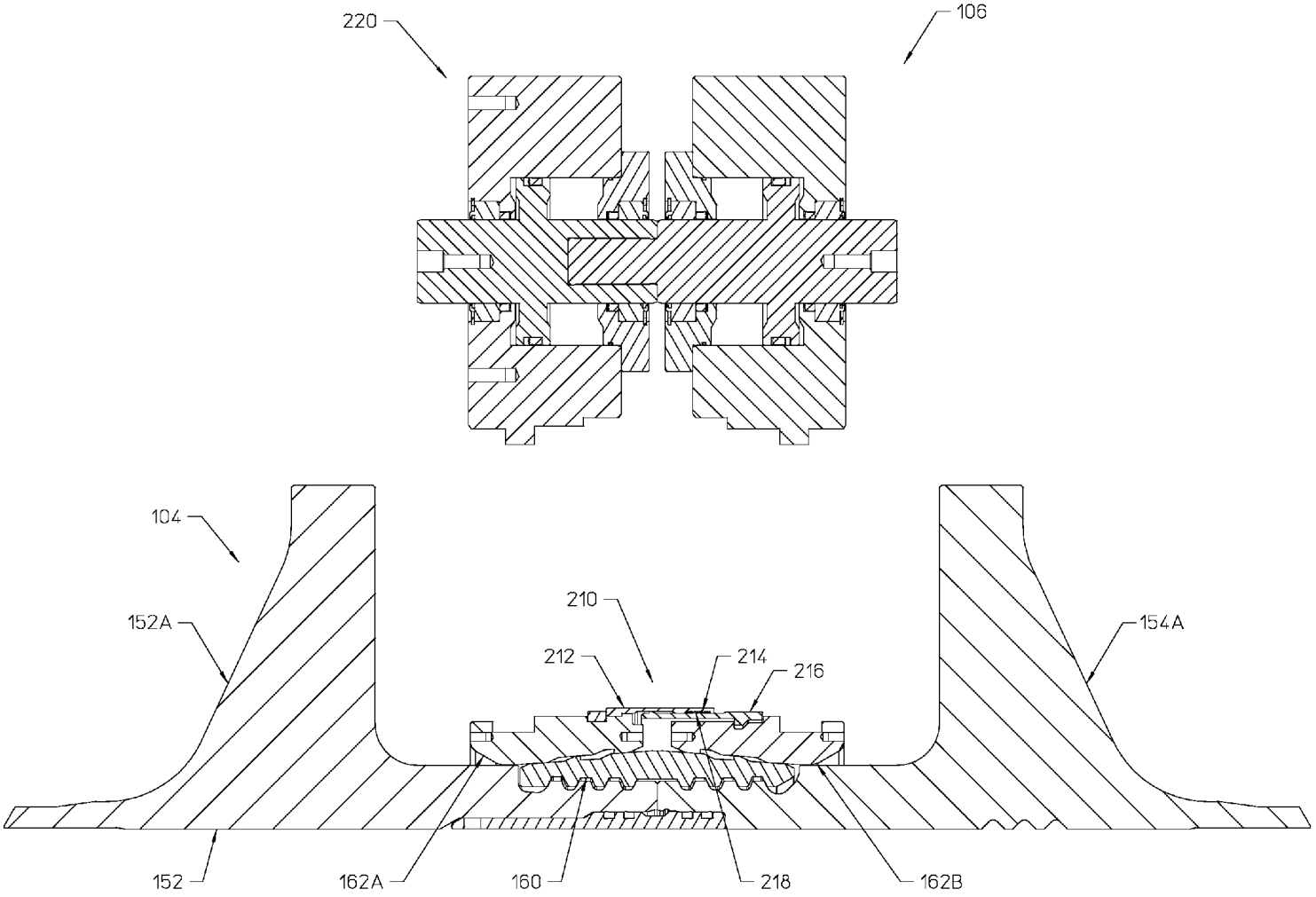

When the manipulator sections 220 are retracted from the riser joint connector 104, the split inner ring 216 may expand back outward (e.g., via a biasing feature) to engage with the outer ring 212, as shown in FIG. 14D. The split inner ring 216 may be forced into a locking profile of the outer ring 212 (e.g., by seating the profile 218 into the corresponding profile 214), thereby closing the secondary locking mechanism 210 to lock the riser joint connector 104 in place. The secondary locking mechanism 210 may effectively lock the riser joint connector 104 in place such that the lock ring 160 cannot disengage with the tubular assemblies 152 and 154 in response to vibrations. Thus, the secondary locking mechanism 210 may ensure that the riser joint connector 104 does not unlock due to vibrations or other external forces experienced at the connection.

As described above, the secondary locking mechanism 210 of FIGS. 14A-14D may be closed to lock the riser joint connector 104 via the same actuation tool 106 (e.g., manipulator 220) used to actuate the primary cam ring 162 and lock ring 160 into place. This enables a second (redundant) lock to be established between the tubular assemblies 152 and 154 without the use of an additional manipulator tool for locking/unlocking the secondary locking mechanism 210. The use of such an additional tool could lead to undesirable system complexity. For example, other tools for actuating secondary locks might use ratcheting mechanisms to close the second lock, and such tools can be difficult to manufacture, use an undesirable amount of locking force, and wear relatively easy. The illustrated secondary locking mechanism 210, however, utilizes a simpler, more reliable lock design that can be actuated using a simple mechanical shoulder built into the manipulator section 220.

Turning back to FIG. 4, the riser joint connector 104 may include one or more auxiliary lines 166. For example, the auxiliary lines 166 may include one or more of hydraulic lines, choke lines, kill lines, and boost lines. The auxiliary lines 166 may extend through the flange 152A and a flange 154A of the lower tubular assembly 154. The auxiliary lines 166 may be adapted to mate between the flanges 152A, 154A, for example, by way of a stab fit.

The riser joint connector 104 may include one or more connector orientation guides 168. A given connector orientation guide 168 may be disposed about a lower portion of the riser joint connector 104. By way of example without limitation, the connector orientation guide 168 may be coupled to the flange 154A. The connector orientation guide 168 may include one or more tapered surfaces 168A formed to, at least in part, orient at least a portion of the riser joint connector 104 when interfacing one of the dog assemblies (e.g., 114 of FIGS. 3A and 3B). When the dog assembly 114 described above contacts one or more of the tapered surfaces 168A of the connector orientation guide 168, the one or more tapered surfaces 168A may facilitate axial alignment and/or rotational orientation of the riser joint connector 104 by biasing the riser joint connector 104 toward a predetermined position with respect to the dog assembly. In certain embodiments, the connector orientation guide 168 may provide a first stage of an orientation process to orient the lower tubular assembly 154.

The riser joint connector 104 may include one or more orientation guides 170. In certain embodiments, the one or more orientation guides 170 may provide a second stage of an orientation process. A given orientation guide 170 may be disposed about a lower portion of the riser joint connector 104. By way of example without limitation, the orientation guide 170 may be formed in the flange 154A. The orientation guide 170 may include a recess, cavity or other surfaces adapted to mate with a corresponding guide pin 172 (depicted in FIG. 5).

Figure 5:
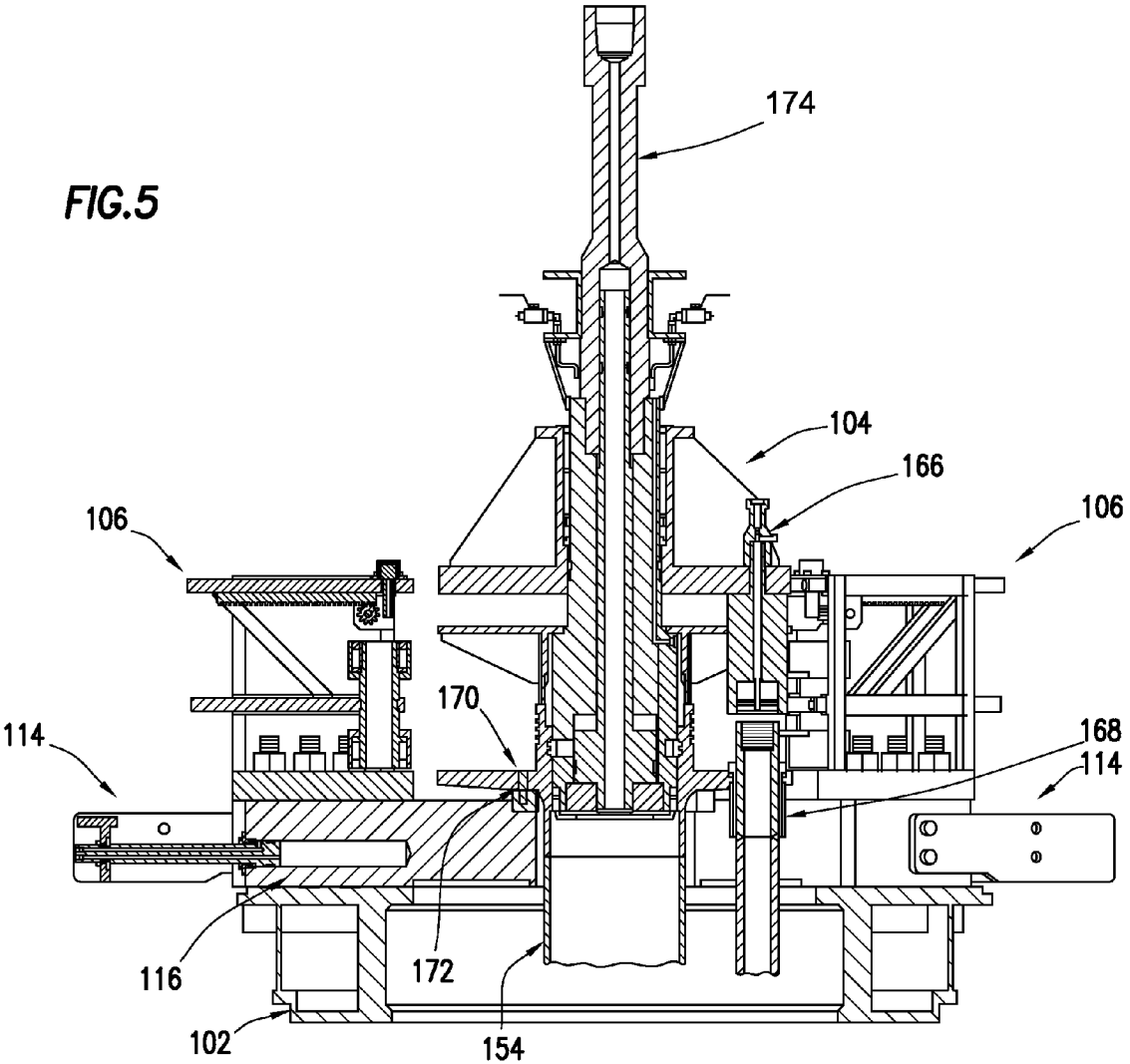
FIG. 5 shows a cross-sectional view of landing a riser section, which may include the lower tubular assembly, in the spider assembly, in accordance with certain embodiments of the present disclosure.

FIG. 5 shows a cross-sectional view of landing a riser section, which may include the lower tubular assembly 154, in the spider assembly 102, in accordance with certain embodiments of the present disclosure. In the example landed state shown, the dogs 116 have been extended to retain the tubular assembly 154, and the two-stage orientation features have oriented the lower tubular assembly 154. Specifically, the connector orientation guide 168 has already facilitated axial alignment and/or rotational orientation of the lower tubular assembly 154, and one or more of the dog assemblies 114 may include a guide pin 172 extending to mate with the orientation guide 170 to ensure a final desired orientation.

A running tool 174 may be adapted to engage, lift, and lower the lower tubular assembly 154 into the spider assembly 102. In certain embodiments, the running tool 174 may be adapted to also test the auxiliary lines 166. For example, the running tool 174 may pressure test choke and kill lines coupled below the lower tubular assembly 154.

In certain embodiments, one or more of the running tool 174, the tubular assembly 154, and auxiliary lines 166 may be fitted with one or more sensors (not shown) to detect position, orientation, pressure, and/or other parameters associated with said components. Corresponding signals may be transferred to an information handling system at any suitable location on the vessel or platform by any suitable means, including wired or wireless means.

Figure 6:
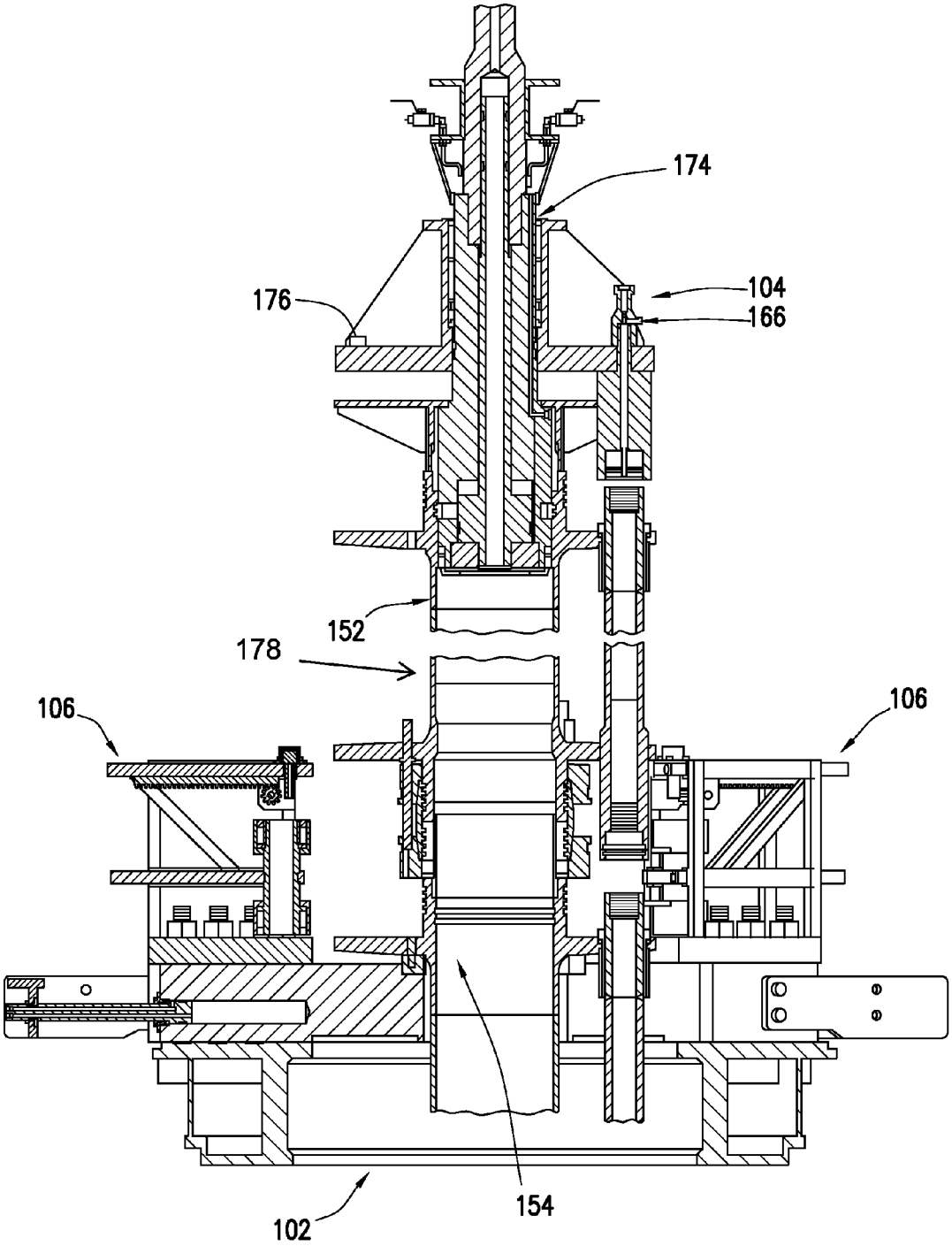
FIG. 6 shows a cross-sectional view of running the upper tubular assembly to the landed lower tubular assembly, in accordance with certain embodiments of the present disclosure.

FIG. 6 shows a cross-sectional view of running the upper tubular assembly 152 to the landed lower tubular assembly 154, in accordance with certain embodiments of the present disclosure. The running tool 174 may be used to engage, lift, and lower the upper tubular assembly 152. The upper tubular assembly 152 may be lowered onto a stab nose 178 of the lower tubular assembly 154.

In certain embodiments, the running tool 174 may include one or more sensors 176 to facilitate proper alignment and/or orientation of the upper tubular assembly 152. The one or more sensors 176 may be located at any suitable positions on the running tool 174. In certain embodiments, the tubular member 152 may be fitted with one or more sensors (not shown) to detect position, orientation, pressure, and/or other parameters of the tubular member 152. Corresponding signals may be transferred to an information handling system at any suitable location on the vessel or platform by any suitable means, including wired or wireless means.

Figure 7:
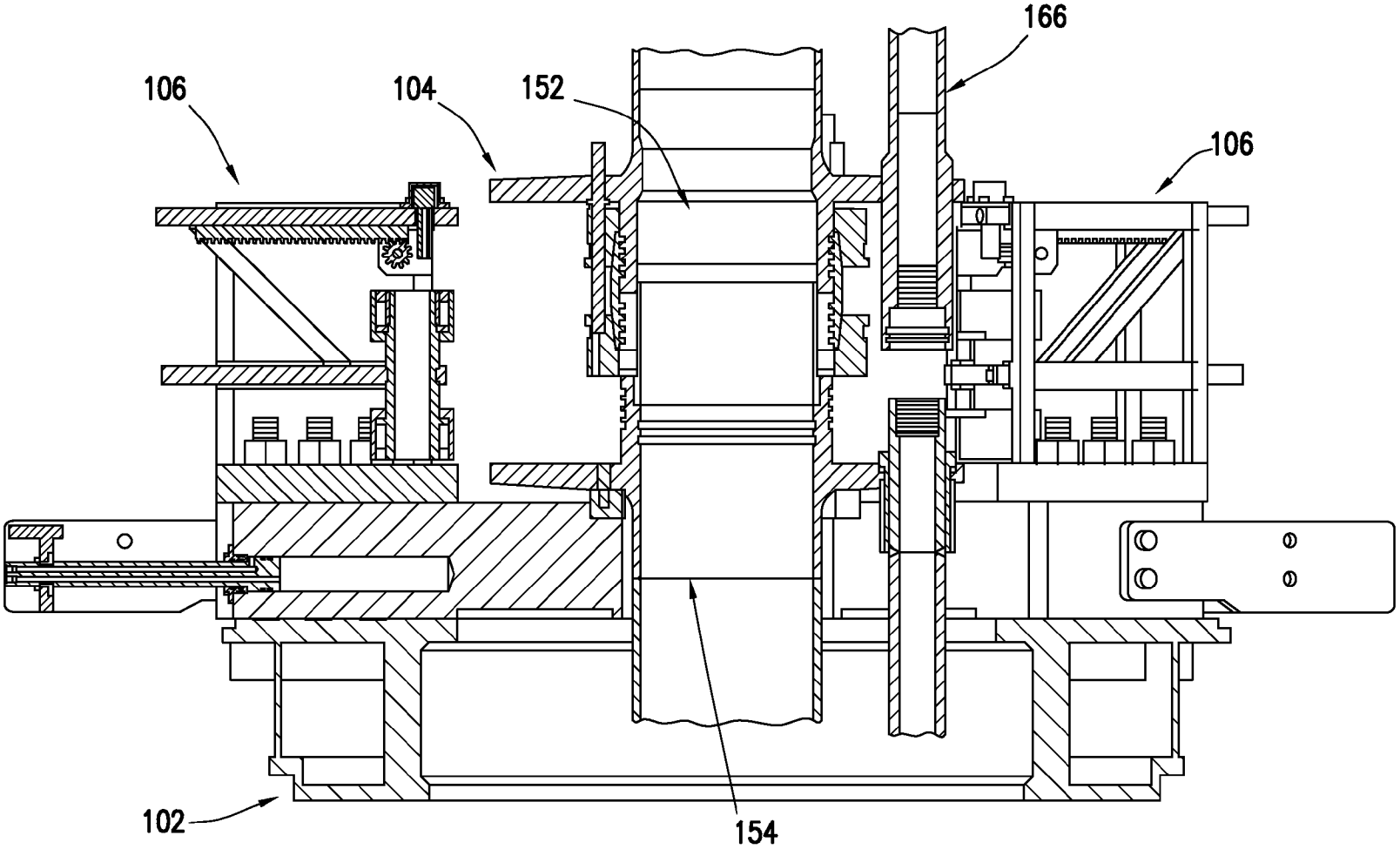
FIG. 7 shows a cross-sectional view of orienting an upper tubular assembly with respect to a lower tubular assembly, in accordance with certain embodiments of the present disclosure.

FIG. 7 shows a cross-sectional view of orienting the upper tubular assembly 152 with respect to lower tubular assembly 154, in accordance with certain embodiments of the present disclosure. It should be understood that orienting the upper tubular assembly 152 may be performed at any suitable stage of the lowering process, or throughout the lower process.

Figure 8:
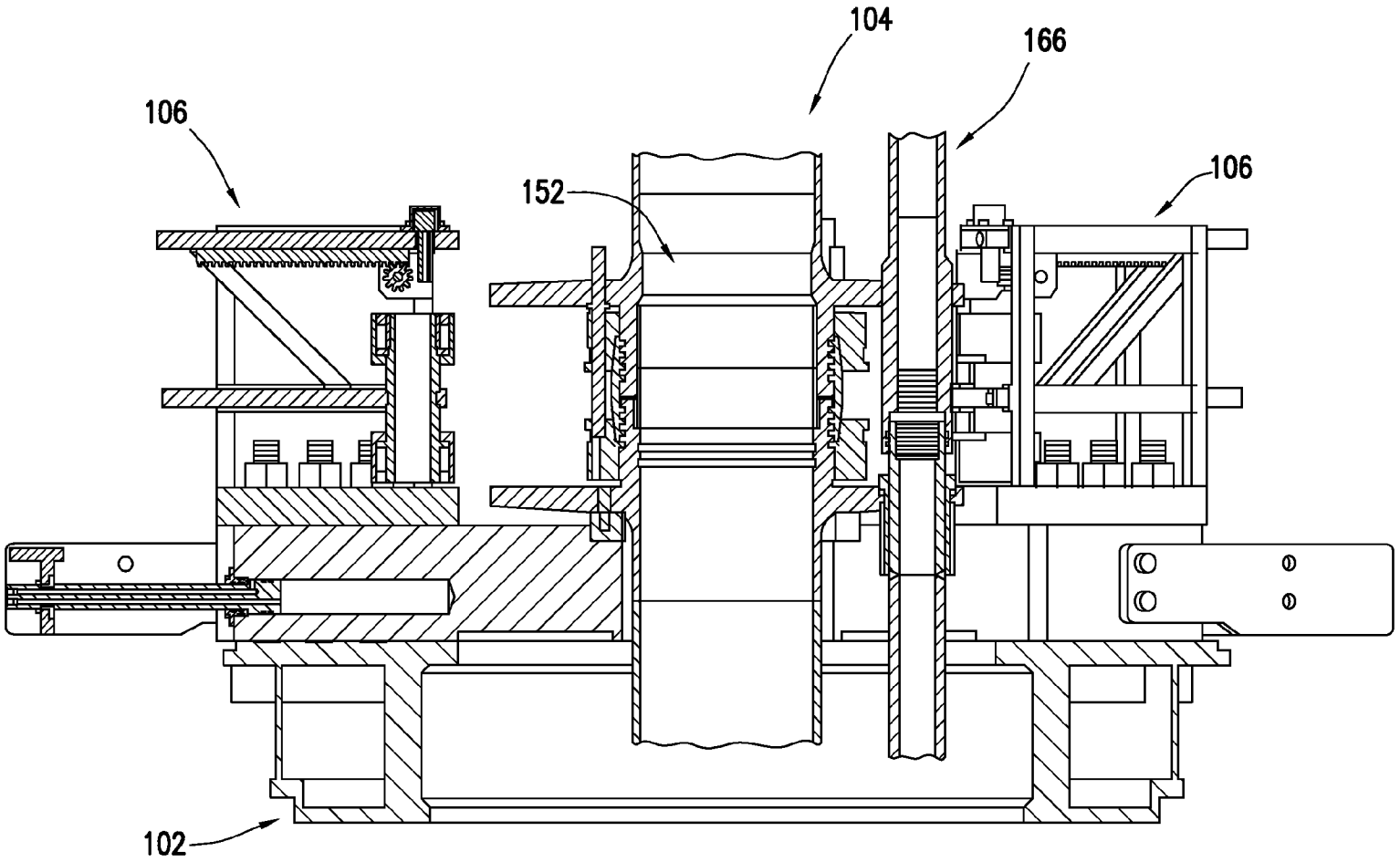
FIG. 8 shows a cross-sectional view of an upper tubular assembly landed, in accordance with certain embodiments of the present disclosure.

FIG. 8 shows a cross-sectional view of the upper tubular assembly 152 landed, in accordance with certain embodiments of the present disclosure.

Figure 9:
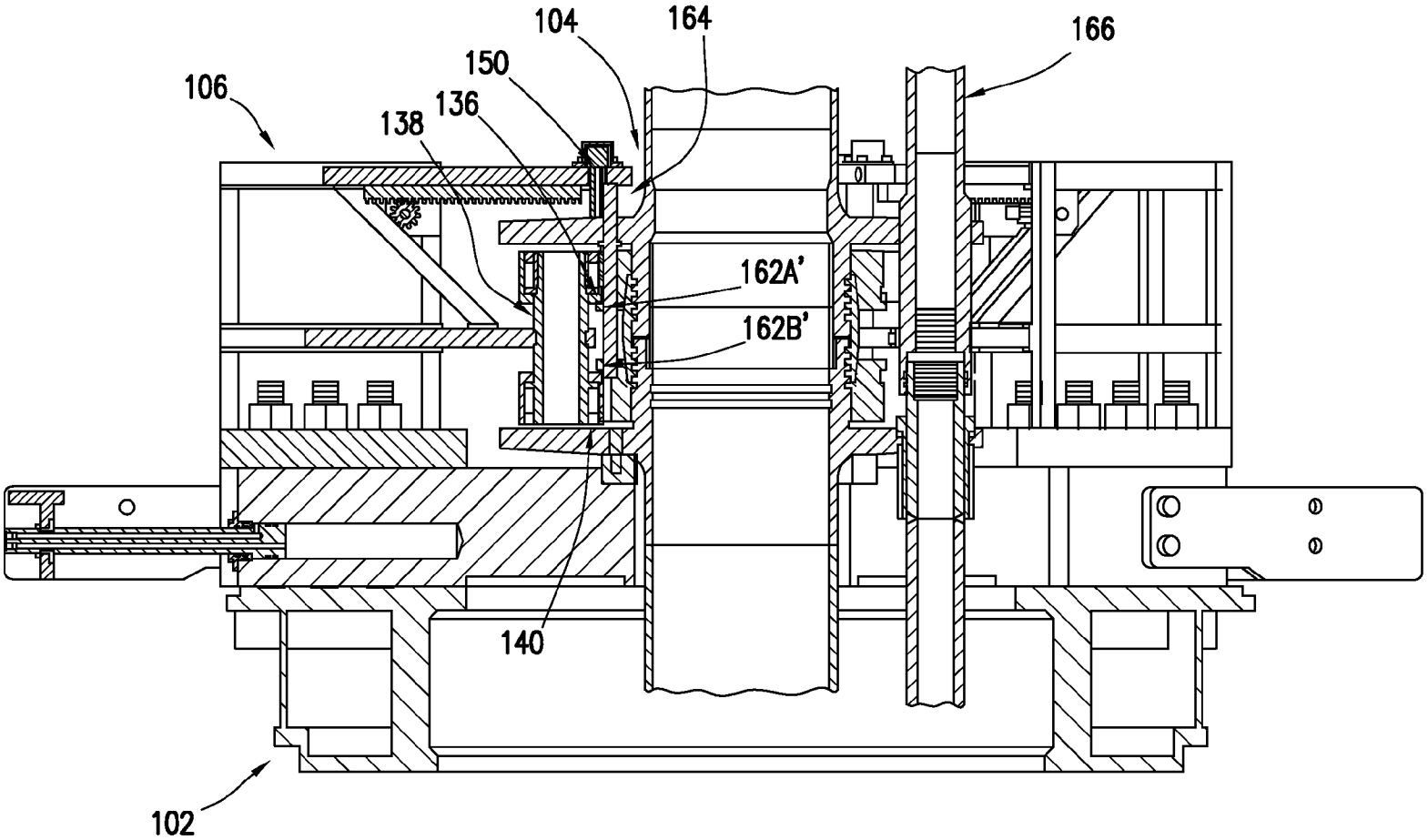
FIG. 9 shows a cross-sectional view of the connector actuation tool engaging a riser joint prior to locking a riser joint, in accordance with certain embodiments of the present disclosure.

FIG. 9 shows a cross-sectional view of the connector actuation tool 106 engaging the riser joint connector 104 prior to locking the riser joint connector 104, in accordance with certain embodiments of the present disclosure. As depicted, the actuation piston mandrel 138 may be extended toward the riser joint connector 104. The upper actuation piston 136 may engage the lug 162A' and/or an adjacent groove of the cam ring 162. Likewise, the lower actuation piston 140 may engage the lug 162B' and/or an adjacent groove of the cam ring 162. The splined member 150 may also be extended toward the riser joint connector 104. As depicted, the splined member 150 may engage the locking member 164. In various embodiments, the actuation piston mandrel 138 and the splined member 150 may be extended simultaneously or at different times.

Figure 10:
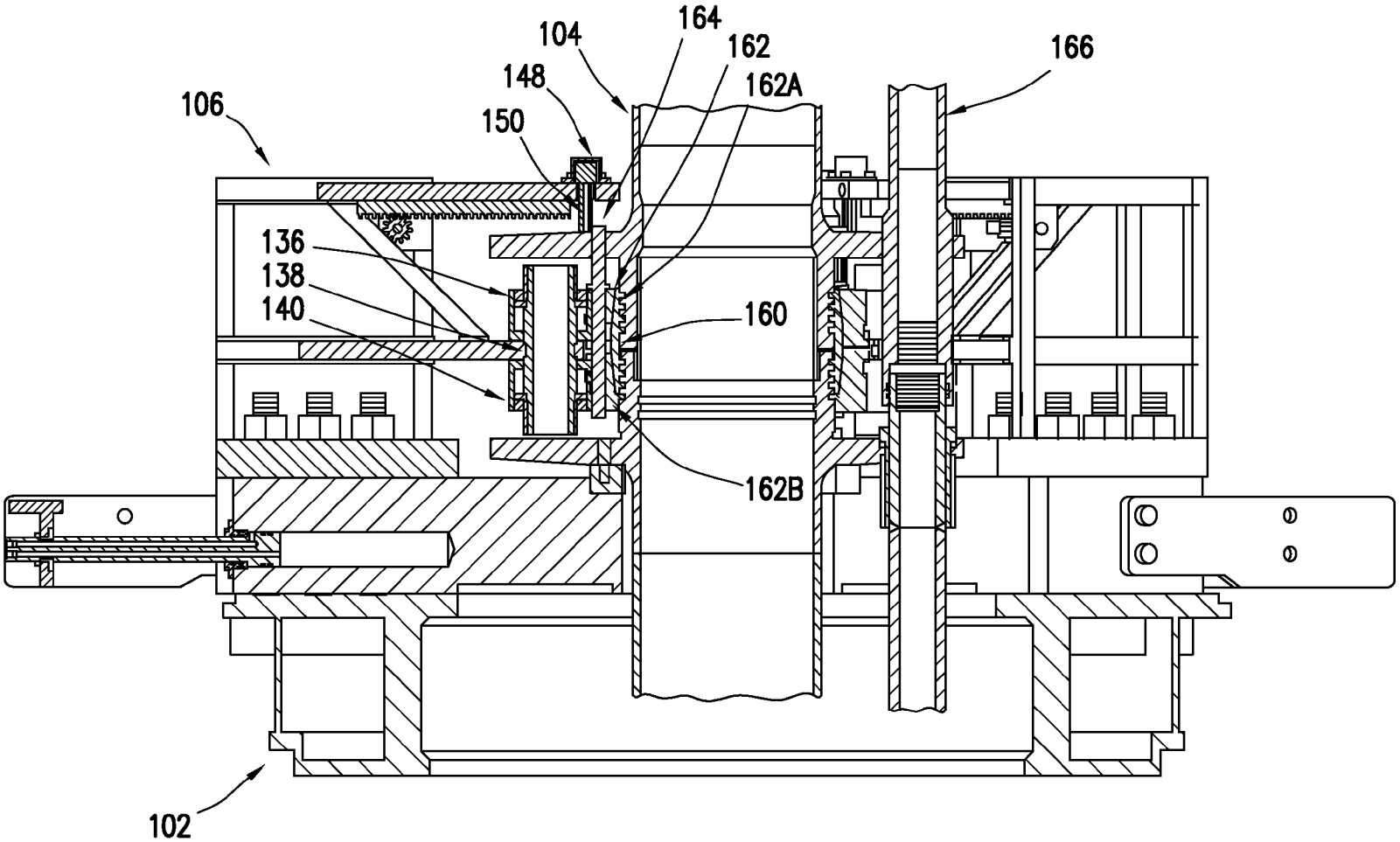
FIG. 10 shows a cross-sectional view of a connector actuation tool locking a riser joint, in accordance with certain embodiments of the present disclosure.

FIG. 10 shows a cross-sectional view of the connector actuation tool 106 locking the riser joint connector 104, in accordance with certain embodiments of the present disclosure. As depicted, with suitable hydraulic pressure having been applied to the upper and lower actuation pistons 136, 140, the upper and lower actuation pistons 136, 140 moved longitudinally along the actuation piston mandrel 138 toward a middle portion of the actuation piston mandrel 138. The upper member 162A and the lower member 162B of the cam ring 162 are thereby forced toward one another, which may act as a clamp that in turn forces the lock ring 160 inward to a locked position via the inner cam surfaces of the cam ring 162. As depicted, the locking member 164 may be in a locked position after the motor 148 has driven the splined member 150, which in turn has driven the locking member 164 into the locked position to lock the cam ring 162 in a clamped position. In various embodiments, the locking member 164 may be actuated into the locked position as the cam ring 162 transitions to a locked position or at a different time.

Figure 11:
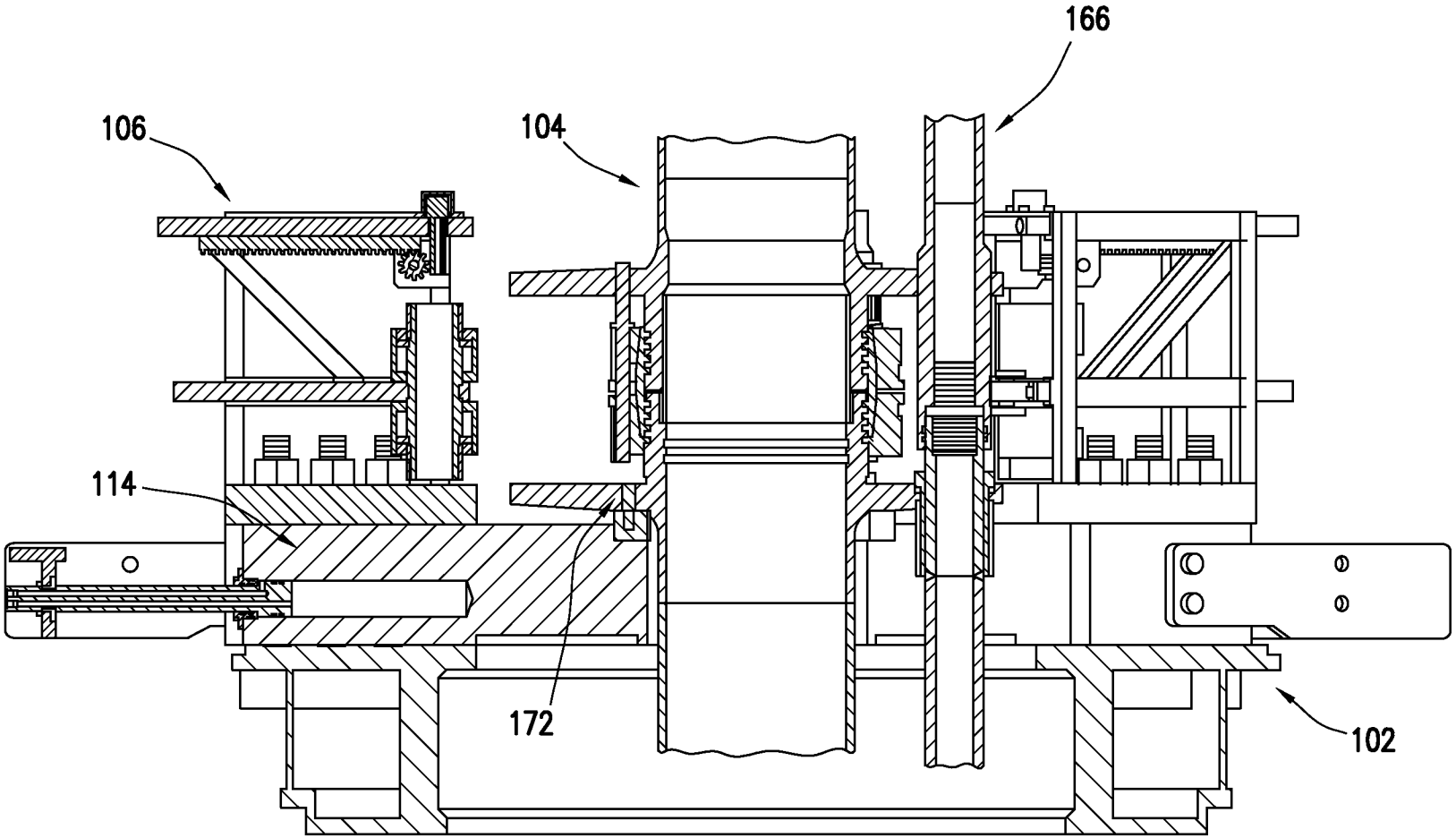
FIG. 11 shows a cross-sectional view of the connector actuation tool retracted, in accordance with certain embodiments of the present disclosure.

FIG. 11 shows a cross-sectional view of the connector actuation tool 106 retracted, in accordance with certain embodiments of the present disclosure. From that position, the running tool 174 (depicted in previous figures) may engage the riser joint connector 104 and lift the riser joint connector 104 away from the guide pin 172. The dogs 114 may be retracted, the riser joint connector 104 may be lowered passed the spider assembly 102, and the process of landing a next lower tubular may be repeated. It should be understood that a dismantling process may entail reverses the process described herein.

Some embodiments of the riser joint connector 104 may feature a modular design that enables a coupling used to lock the tubular assemblies 152/154 together to be selectively removable from the tubular assemblies. An embodiment of one such modular riser joint connector assembly 250 is illustrated in FIGS. 16A-16D. In this embodiment, the riser joint connector assembly 250 includes a coupling 252 that can be selectively disposed on or removed from one or both of the upper and lower tubular assemblies. In the illustrated embodiment, the coupling 252 is shown being selectively engaged and disengaged with the upper tubular assembly 152. The coupling 252 may include at least the lock ring 160 and the cam ring 162. In some embodiments, the coupling 252 may include additional components such as, for example, the secondary locking mechanism 210 described above with reference to FIGS. 14A-14D. Other components or arrangements of such components used to lock adjacent tubular assemblies together may form the modular coupling 252 in other embodiments.

Figure 16A:
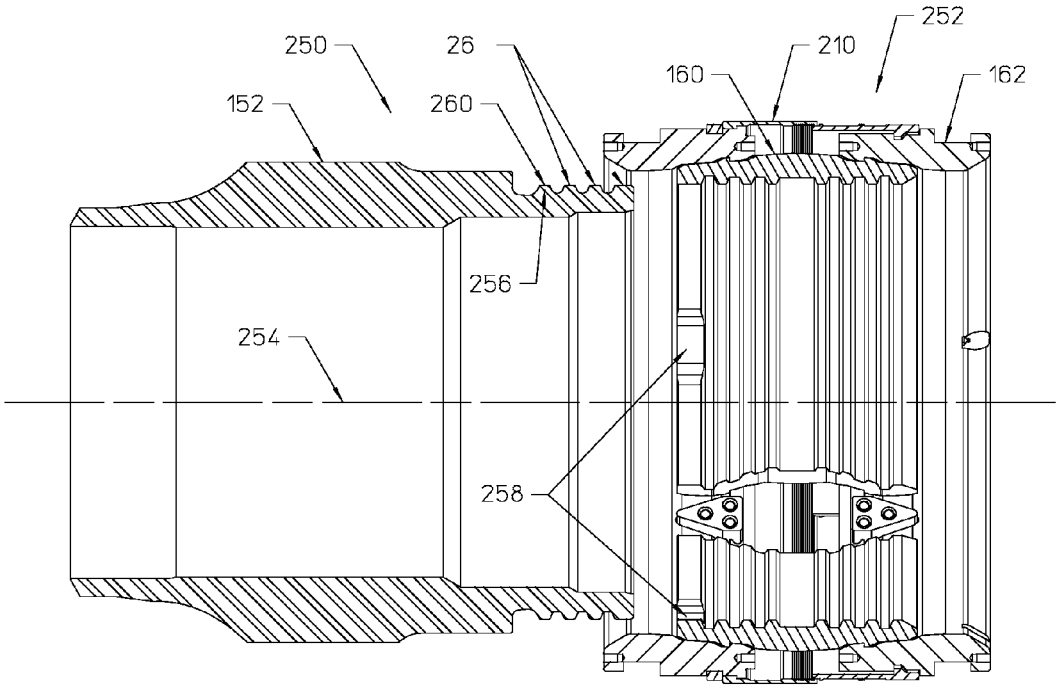
FIGS. 16A-16D show cross-sectional views of a riser joint being selectively engaged and disengaged with a removable connector assembly, in accordance with certain embodiments of the present disclosure.

To position and secure the coupling 252 onto the upper tubular assembly 152, the coupling 252 may be positioned proximate an end of the upper tubular assembly 152, as shown in FIG. 16A. The coupling 252 may be rotated about an axis 254 to align a projection 256 extending radially outward from the upper tubular assembly 152 into a corresponding slot 258 formed through the coupling 252. As illustrated, the coupling 252 may be equipped with multiple such slots 258 to accommodate a number of complementary projections 256 extending from the upper tubular assembly 152. In the illustrated embodiment, these projections 256 may include an extended tooth or extended portions of a tooth 260 used to engage the lock ring 160 when the lock ring 160 is sealed onto the tubular assembly 152. As illustrated, the other teeth 262 on the tubular assembly 152 that are used to engage the corresponding teeth on the lock ring 160 may be shorter (i.e., extending a shorter distance radially outward) than the extended tooth 260. In other embodiments, the tubular assembly 152 may include two or more extended teeth 260 to be received into the slots 258 formed within the coupling 252.

Figure 15:
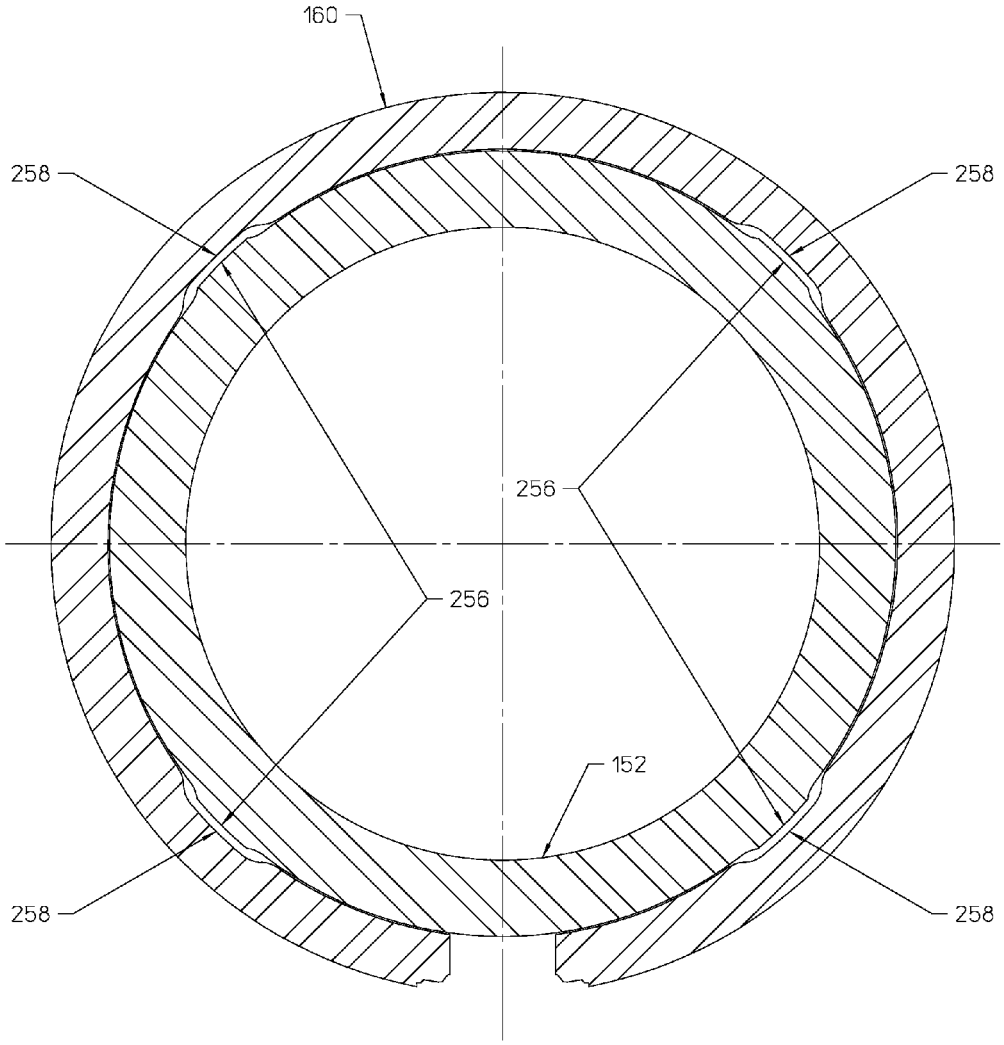
FIG. 15 shows a cross-sectional view of an interface between a riser joint and a removable connector assembly, in accordance with certain embodiments of the present disclosure.
Figure 16B:
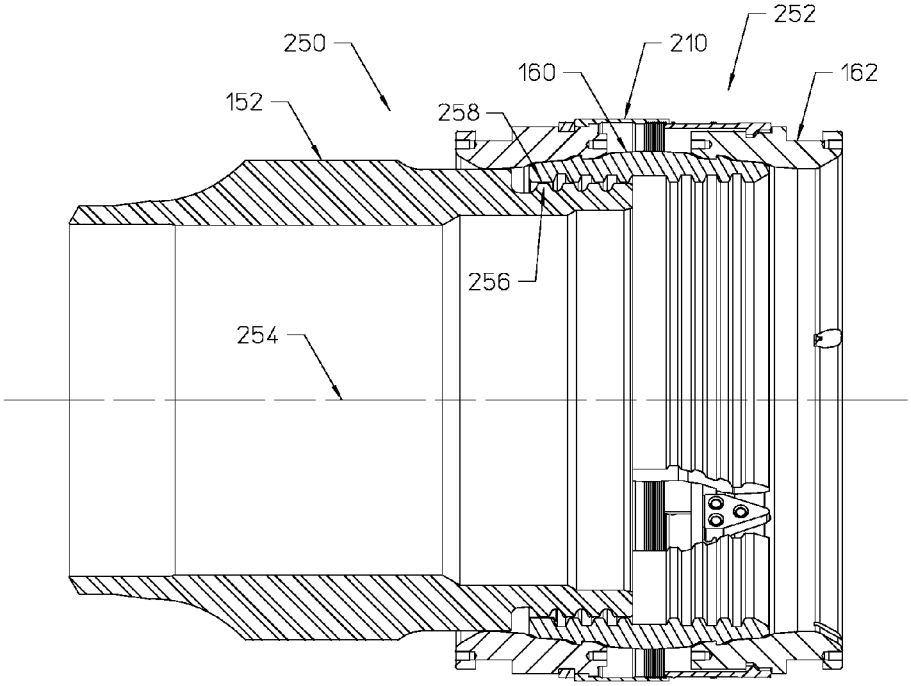
Figure 16C:
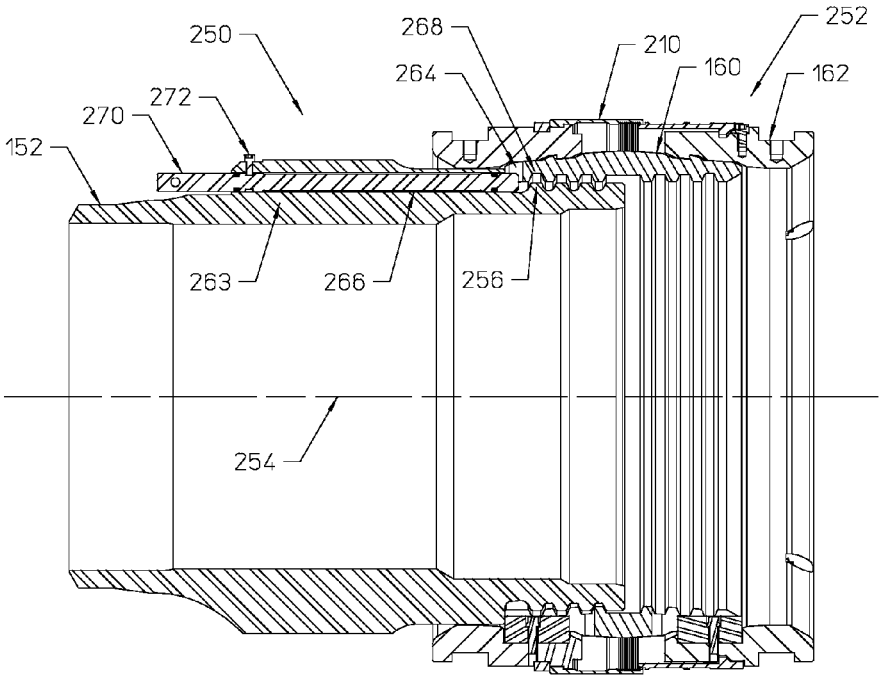

FIG. 15 illustrates a cross-sectional view of the interface between the projections 256 of the tubular assembly 152 and the corresponding slots 258 in the coupling 252. As illustrated, the slots 258 may be formed in the lock ring 160. FIG. 16B illustrates the extended tooth projection 256 being positioned within the corresponding slot 258 of the lock ring 160. Once the projection 256 is received through the slot 258 in the coupling 252, the coupling 252 may be moved further onto the tubular assembly 152 such that the projection 256 moves past the slot 258 and into the engagement portion of the lock ring 160. The "engagement portion" of the lock ring may include the toothed profile of the locking mechanism 160, as illustrated. That is, the coupling 252 may be positioned over the tubular assembly 152 such that the projection 256 enters the coupling 252 through the appropriately oriented slot 258 and then passes through the slot 258 into a toothed profile that enables rotation of the coupling 252 with respect to the tubular assembly 152.

From this position, the coupling 252 may be rotated about the axis 254, with respect to the tubular assembly 152, to align other components of the coupling 252 and the tubular assembly 152. For example, in the illustrated embodiment of FIG. 16C, the coupling 252 may be rotated with respect to the tubular assembly 152 to align a portion 263 of the tubular assembly 152 with another slot 264 formed through the coupling 252. The slot 264 may be radially offset from the other one or more slots 258 formed through the lock ring 160. Similarly, the portion 263 of the tubular assembly 152 may be radially offset from the one or more projections 256 extending from the tubular assembly 152. In the illustrated embodiment, the portion 263 of the tubular assembly 152 includes a channel or slot 266 through which a locking mechanism may be received, and a shortened section 268 of the lock ring 160 may define the additional slot 264 within the coupling 252.

Once the coupling 252 is rotated so that the projection 256 is no longer aligned with the corresponding slot 258, the coupling 252 is generally secured to the tubular assembly 152. To ensure that the coupling 252 stays securely fastened onto the tubular assembly 152, the modular riser joint connector assembly 250 may further include a removable locking pin 270 that can be disposed at least partially through the portion 263 of the tubular assembly 152 and through the slot 264. This locking pin 270 is disposed in the locking position in the illustrated embodiment of FIG. 16C. The locking pin 270 may be secured via a retainer bolt 272 disposed through an opening in the tubular assembly 152 and screwed into the locking pin 270. When the locking pin 270 is secured in this position, it may prevent the coupling 252 from rotating with the respect to the tubular assembly 152. Thus, the locking pin 270 may be used to selectively secure the coupling 252 to the end of the tubular assembly 152 as shown.

Figure 16D:
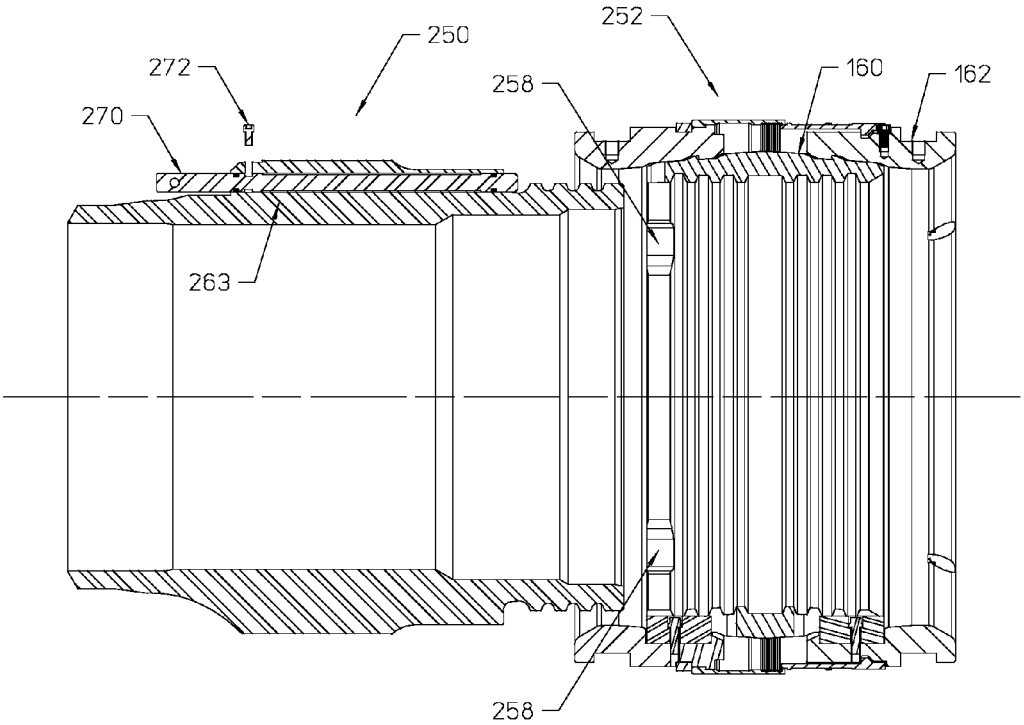

As described above, it is desirable to make the coupling 252 selectively removable from the tubular assembly 152. In the event that the coupling 252 malfunctions during the automated coupling process, an operator may remove the retainer bolt 272 and the locking pin 270, rotate the coupling 252 so that the projections 256 once again align with the slots 258 in the coupling 252, and slide the coupling 252 off the tubular assembly 152. This removal of the locking pin 270 and the coupling 252 is illustrated in FIG. 16D. The defective coupling may then be replaced with a new coupling 252, without an operator having to remove or dispose of the entire tubular assembly 152.

In some embodiments, the coupling 252 may incorporate a spreader wedge to ensure that the cam ring 162 can be opened. This may keep the coupling 252 from becoming stuck in the locked position, so that the coupling 252 may later be removed from the tubular assembly 152 as desired.

The disclosed modular riser joint connector assembly 250 may allow an end user to quickly remove, replace, and/or service the coupling 252. The user would not have to remove the entire tubular assembly 152 along with the coupling 252, since the coupling 252 is removable from the tubular assembly 152. This may save the end user time in performing service, repairs, and replacements of the riser parts. In the event that a flange (e.g., 152A) of the tubular assembly 152 becomes damaged, the coupling 252 may be removed from the unusable tubular assembly 152 and repositioned on a new tubular assembly 152. This may enable the operators to service the riser connections with fewer total parts than would be necessary if the coupling and the tubular assembly were permanently attached.

Accordingly, certain embodiments of the present disclosure allow for hands-free riser section coupling systems and methods. Certain embodiments allow for minimal and remote operator involvement. As a result, certain embodiments provide safety improvements in part by eliminating or significantly reducing direct operator involvement that would otherwise expose an operator to risks of injury, fatigue, and increased potential for human error. Moreover, certain embodiments allow for increased speed and efficiency in the riser section coupling process. Certain embodiments allow for lighter coupling components, for example, by eliminating or significantly reducing the need for heavy bolts and flanges. This may save material usage and augment the speed and efficiency of the riser section coupling process.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A riser coupling system, comprising:

a riser joint connector comprising:

a first tubular assembly;

a second tubular assembly;

a cam ring having an upper member and a lower member, wherein the upper member and the lower member are adjustable to retain the first tubular assembly and the second tubular assembly together;

a lock ring, wherein movement of the upper member of the cam ring and the lower member of the cam ring toward each other engages the lock ring to secure the first tubular assembly to the second tubular assembly;

a locking member adjustable to retain the cam ring in a locked position; and a radio frequency identification (RFID) tag disposed on the first tubular assembly;

a spider assembly to receive the riser joint connector, the spider assembly comprising a connector actuation tool, wherein the connector actuation tool comprises:

a dog assembly configured to selectively extend a dog to engage the riser joint connector;

a clamping tool to actuate the upper cam ring member and the lower cam ring member of the riser joint connector;

a splined member to actuate the locking member; and a RFID reader for detecting a signal from the RFID tag on the first tubular assembly; and a running tool configured to move the first tubular assembly into orientation with the second tubular assembly based on the signal detected via the RFID reader.

2. The riser coupling system of claim 1, further comprising a controller communicatively coupled to the RFID reader to determine whether the first tubular assembly is in alignment with the spider assembly based on the signal detected via the RFID reader.

3. The riser coupling system of claim 2, wherein the controller is communicatively coupled to the running tool to output a control signal for the running tool to lower the first tubular assembly into engagement with the second tubular assembly when the first tubular assembly is in alignment with the spider assembly.

4. The riser coupling system of claim 2, wherein the controller is communicatively coupled to the connector actuation tool to output a control signal to the connector actuation tool for coupling the first tubular assembly to the second tubular assembly when the first tubular assembly is in alignment with the spider assembly.

5. The riser coupling system of claim 1, wherein the RFID tag is disposed on a flange of the first tubular assembly.

6. The riser coupling system of claim 1, further comprising a plurality of RFID tags disposed on the first tubular assembly.

7. The riser coupling system of claim 1, wherein the RFID reader is operable to emit a constant power level radio frequency signal to the RFID tag.

8. The riser coupling system of claim 1, wherein the spider assembly is remotely operated.

9. The riser coupling system of claim 1, wherein the clamping tool comprises an upper actuation piston, an actuation piston mandrel and a lower actuation piston.

10. The riser coupling system of claim 1, wherein the dog assembly further comprises a piston assembly, wherein the piston assembly is operable to extend the dog to engage the riser joint connector to retain the second tubular assembly in the spider assembly.

11. A riser coupling system, comprising:

a riser joint connector comprising:

a first tubular assembly coupled to a second tubular assembly;

a cam ring having an upper member and a lower member, wherein the upper member and the lower member are adjustable to retain the first tubular assembly and the second tubular assembly together;

a lock ring, wherein movement of the upper member and the lower member toward each other engages the lock ring to secure the first tubular assembly to the second tubular assembly; and a radio frequency identification (RFID) tag disposed on the first tubular assembly;

a spider assembly having a connector actuation tool for coupling the first tubular assembly with a second tubular assembly, wherein the spider assembly receives the riser joint connector and wherein the connector actuation tool comprises:

a dog assembly, wherein the dog assembly selectively extends a dog to engage the riser joint connector;

a clamping tool, wherein the clamping tool couples the first tubular assembly and the second tubular assembly; and a splined member to actuate a locking member of the riser joint connector;

a RFID reader disposed on the spider assembly for detecting a signal emitted from the RFID tag on the first tubular assembly; and a controller communicatively coupled to the RFID reader to determine an angular orientation of the first tubular assembly with respect to the second tubular assembly based on the signal detected via the RFID reader.

12. The riser coupling system of claim 11, further comprising a running tool communicatively coupled to the controller for orienting the first tubular assembly into an aligned angular orientation with respect to the spider assembly.

13. The riser coupling system of claim 11, wherein the RFID tag is disposed on a flange of the first tubular assembly.

14. The riser coupling system of claim 11, further comprising a plurality of RFID tags disposed on the first tubular assembly.

15. The riser coupling system of claim 11, wherein the RFID reader is operable to emit a constant power level radio frequency signal to the RFID tag.

16. A method, comprising:

disposing a riser joint connector proximate a spider assembly comprising a connector actuation tool, wherein the riser joint connector comprises a first tubular assembly having a radio frequency identification (RFID) tag disposed thereon;

detecting a signal emitted from the RFID tag via a RFID reader disposed on the spider assembly;

determining an angular orientation of the first tubular assembly relative to a second tubular assembly based on the signal detected by the RFID reader;

rotating the first tubular assembly into alignment with the second tubular assembly via a running tool based on the determined angular orientation; and actuating the riser joint connector via the connector actuation tool to couple the first tubular assembly with the second tubular assembly.

17. The method of claim 16, wherein the riser joint connector further comprises a cam ring having an upper member and a lower member, and a lock ring; further comprising engaging the cam ring of the riser joint connector via the connector actuation tool, and actuating the upper member and the lower member of the cam ring toward each other via the connector actuation tool to secure the lock ring against the first and second tubular assemblies.

18. The method of claim 17, further comprising actuating a locking member of the riser joint connector via a splined member of the connector actuation tool.

19. The method of claim 16, further comprising outputting a control signal from a controller coupled to the RFID reader to the running tool to rotate the first tubular assembly.

20. The method of claim 16, further comprising emitting a constant power level radio frequency signal from the RFID reader to the RFID tag.

* * * * *